US008157636B2

(12) United States Patent
Okuaki

(10) Patent No.: US 8,157,636 B2
(45) Date of Patent: Apr. 17, 2012

(54) GAME SYSTEM, AND GAME APPARATUS AND MANAGEMENT APPARATUS CONSTITUTING THE SAME

(75) Inventor: Masato Okuaki, Kanagawa (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 377 days.

(21) Appl. No.: 12/457,078

(22) Filed: Jun. 1, 2009

(65) Prior Publication Data

US 2009/0298595 A1 Dec. 3, 2009

(30) Foreign Application Priority Data

May 30, 2008 (JP) ..... 2008-143741

(51) Int. Cl.
*A63F 9/24* (2006.01)

(52) U.S. Cl. ..... 463/17; 463/27

(58) Field of Classification Search ..... 463/16, 463/17, 19, 21, 42
See application file for complete search history.

(56) References Cited

U.S. PATENT DOCUMENTS

| | | | | |
|---|---|---|---|---|
| 7,731,581 | B2 * | 6/2010 | Chamberlain et al. | 463/19 |
| 7,959,507 | B2 * | 6/2011 | Cannon | 463/21 |
| 2008/0300040 | A1 | 12/2008 | Goto et al. | |
| 2009/0186692 | A1 * | 7/2009 | Thomas et al. | 463/29 |
| 2009/0247260 | A1 | 10/2009 | Goto et al. | |
| 2009/0264175 | A1 | 10/2009 | Goto et al. | |
| 2010/0160020 | A1 * | 6/2010 | Okuaki | 463/17 |
| 2010/0210335 | A1 | 8/2010 | Goto et al. | |
| 2010/0216546 | A1 | 8/2010 | Goto et al. | |
| 2010/0222131 | A1 | 9/2010 | Goto et al. | |
| 2010/0222136 | A1 | 9/2010 | Goto et al. | |
| 2010/0222137 | A1 | 9/2010 | Goto et al. | |
| 2010/0240456 | A1 | 9/2010 | Goto et al. | |
| 2010/0267447 | A1 | 10/2010 | Goto et al. | |
| 2010/0273559 | A1 | 10/2010 | Goto et al. | |
| 2010/0323787 | A1 | 12/2010 | Omoto | |
| 2010/0331071 | A1 | 12/2010 | Uchiyama et al. | |
| 2011/0003635 | A1 | 1/2011 | Uchiyama et al. | |

FOREIGN PATENT DOCUMENTS

| | | | |
|---|---|---|---|
| EP | 1513115 | A2 * | 3/2005 |
| EP | 1624422 | A1 | 2/2006 |
| JP | 2002-210221 | A | 7/2002 |
| JP | 2002-253842 | A | 9/2002 |
| JP | 2004-105455 | A | 4/2004 |
| JP | 2004-215698 | A | 8/2004 |
| JP | 2006-043127 | A | 2/2006 |
| JP | 2006-320461 | A | 11/2006 |
| JP | 2007-029145 | A | 2/2007 |
| JP | 2008-029405 | A | 2/2008 |
| WO | WO-2010-095480 | A1 | 8/2010 |
| WO | WO-2010-095481 | A1 | 8/2010 |

OTHER PUBLICATIONS

Chinese Office Action of corresponding CN Application No. 200910145210.9, Jun. 29, 2010.

(Continued)

*Primary Examiner* — Fernando L Toledo
(74) *Attorney, Agent, or Firm* — Ditthavong Mori & Steiner, P.C.

(57) ABSTRACT

A game system, and arcade game apparatus and management apparatus constituting the same are disclosed. In the game system, each game apparatus change at the same timing to a second mode in which a jackpot drawing is carried out in a state that a jackpot prize winning probability is high. When the jackpot prize is awarded during the second mode, a winning notice is sent to a management apparatus via communication network. The management apparatus transmits second mode end information to all the game apparatus when the number of game apparatus sending the winning notice reaches a predetermined number. After that, the game apparatus operating in the second mode changes to a first mode in which the jackpot drawing is carried out in a state that the winning probability of the jackpot prize is low.

24 Claims, 22 Drawing Sheets

OTHER PUBLICATIONS

Japanese Office Action of Patent Application No. TokuGan2008-143741 mailed on Mar. 5, 2010.

Chinese Office Action to correspnding CN Patent Application No. 2009-10145210.9, dated Jan. 27, 2011, pp. 1-3.

Japanese Office Action Final to corresonding JP Parent Application No. 2008-143741 dated Jul. 1, 2011, pp. 1-3.

Japanese Office Action to corresponding JP Patent Application No. 2008-143741 dated Nov. 5, 2010, pp. 1-4.

U.S. Appl. No. 13/148,521, Masato Okuaki.

U.S. Appl. No. 13/148,529, Masato Okuaki.

U.S. Appl. No. 13/148,521, Masato Okuaki et al, entitled "Game System", filed on Aug. 9,2011.

U.S. Appl. No. 13/148,529, Masato Okuaki et al., entitled "Game Apparatus", filed on Aug. 9, 2011.

* cited by examiner

[FIG. 3

GAME SYSTEM, AND GAME APPARATUS AND MANAGEMENT APPARATUS CONSTITUTING THE SAME

CROSS-REFERENCE TO RELATED APPLICATIONS

The disclosure of Japanese Patent Application No. 2008-143741, filed May 30, 2008, including its specification, claims and drawings, is incorporated herein by reference in its entirety.

FIELD OF THE INVENTION

The present invention relates to a game system that comprises a plurality of game apparatuses for business use (arcade game apparatuses) installed in a game facility such as a game center or the like and a management apparatus connected with these arcade game apparatuses via a communication network, and the arcade game apparatus and the management apparatus constituting the game system.

BACKGROUND OF THE INVENTION

Token-operated game machines (arcade game apparatuses) installed in a game center or the like control the progression of a game on the condition that tokens (bet-objects) are received from a player and pay out to the player a predetermined number of tokens (payout-objects) according to the result of the game. In such token-operated game machines, it has been known that there is a game machine in which a jackpot game is carried out (for example, Japanese Published Unexamined Patent Application No. 2002-253842). A description is given of one example of a token-operated game machine utilizing a drawing machine for jackpot game. For example, the number of tokens corresponding to part of the number of tokens received from a player is added cumulatively, which is retained as payout amount data at a storage unit of the drawing machine for jackpot game. Then, when a predetermined drawing start condition is satisfied, the drawing machine for jackpot game carries out a drawing, thereby decides whether a jackpot prize is awarded or not. When the jackpot prize is awarded by this drawing, the number of tokens shown by the payout amount data is paid out to the player who has satisfied the predetermined drawing start condition, and the payout amount data is reset to an initial value.

In general, when a jackpot prize is awarded, a great number of tokens are paid out to a player who is awarded the jackpot prize. Therefore, a player who has experienced to obtain a great number of tokens by being awarded the jackpot prize cannot forget the experience. Thereby, there are many cases in which the player wishes to play at the token-operated game machine aiming at obtaining a great number of tokens again. That is, in token-operated game machines carrying out the jackpot game, it is expected to give an effect (an effect of attracting players) to promote the further play at the token-operated game machine to the player. In addition, a bystander who see a player winning the jackpot prize see a great number of tokens with his or her own eyes, thereby there are many cases in which the bystander wishes to obtain a great number of tokens by himself or herself in the future. As a result, the willingness of the bystander to be awarded the jackpot prize increases. Therefore, in token-operated game machines carrying out the jackpot game, it is able to expect to get an effect (an effect of attracting players) to promote the play at the token-operated game machine not only to the player who was awarded the jackpot prize but also a bystander who saw to pay out a great number of tokens to this player.

However, a jackpot prize winning probability is set very low because a large number of tokens are paid out as the jackpot prize. Therefore, the frequency of awarding the jackpot prize is low. As a result, the number of players who are awarded the jackpot prize and the number of bystanders who see the player winning the jackpot prize, is small. Consequently, in a token-operated game machine which carries out a conventional jackpot game, there is a problem that such a jackpot hit cannot sufficiently attract them to the jackpot game. By the way, if the jackpot prize winning probability is raised, the frequency of awarding the jackpot prize, can be increased. However, according therewith, the number of tokens shown as payout amount data at time the jackpot prize is awarded, is decreased. As a result, the number of tokens that can be paid out to the jackpot prize winner, is decreased, whereby willingness of players who want to win the jackpot prize, decreases. Therefore, even if the jackpot prize winning probability is merely raised, players are not sufficiently attracted by the jackpot prize. In addition, in not only such a token-operated game machine but also any arcade game apparatus such as a pachinko machine, a slot machine installed in a pachinko parlor, and so on, which carries out a jackpot game, there is the above-described problem.

Furthermore, there is the above-described problem in not only an arcade game apparatus which carries out the jackpot game but also an arcade game apparatus which carries out a drawing to decide whether or not a specified prize whose winning probability is set very low, is awarded. That is, in such an arcade game apparatus, in general, a player who plays a game on the game apparatus, strongly desires to win the specified prize, when the winning probability is set very low. Therefore, when it is determined that the specified prize is awarded to a player, and bystanders see the player winning the specified prize, their willingness to win the specified prize as well, increases. As a result, if a drawing relating to the specified prize whose winning probability is set very low, is adopted in the arcade game apparatus, an effect of attracting players can be expected. However, since the winning probability of the specified prize is set very low, the frequency of awarding the specified prize is low, and the number of bystanders who see a player winning the specified prize is small. Consequently, there is a problem similar to the above-described problem that players cannot be sufficiently attracted thereby.

Moreover, in the arcade game apparatus that carries out the jackpot game, the number of tokens shown as the payout amount data is small for a while after the payout amount data is reset to an initial value, so that the number of tokens to be paid out when the jackpot is hit, is small. Therefore, if the jackpot prize is awarded in this period, the number of tokens awarded to the player as the jackpot prize is small. In this case, the player who is awarded the jackpot prize and bystanders who see the player winning the jackpot prize are not attracted to the game in the arcade game apparatus. As a result, there is a problem that a high effect of attracting players cannot be expected. In addition, not only a token-operated game machine but also any arcade game apparatus such as a pachinko machine, a slot machine installed in a pachinko parlor, and so on, which carry out the jackpot game, have the above-mentioned problem.

The present invention realizes and provides a game system capable of improving the effect of attracting players by utilizing a drawing relating to a specified prize such as a jackpot prize, wherein the winning probability thereof is set very low; an arcade game apparatus; and a management apparatus constituting a game system.

BRIEF SUMMARY OF THE INVENTION

As an aspect of the present invention, it is listed that a game system includes a plurality of game apparatuses; and a management apparatus connected with the game apparatuses via a communication network; wherein each game apparatus comprising: a drawing unit for carrying out a drawing to decide whether a specified prize is won or not in accordance with a predetermined winning probability when a predetermined drawing start condition is satisfied; a game progression control unit for controlling progression of a game utilizing the drawing unit; a mode changing unit for changing an operation mode of the drawing unit between a first mode and a second mode, wherein a winning probability of the specified prize in the first mode is lower than that in the second mode; and a winning notice unit for sending a winning notice to the management apparatus via the communication network when the drawing unit decides a winning of the specified prize in the second mode, wherein the mode changing unit of each game apparatus changes the operation mode of the drawing unit to the second mode at the same timing in each game apparatus, and changes the operation mode of the drawing unit to the first mode when the mode changing unit receives a second mode end information from the management apparatus via the communication network in the second mode, and wherein the management apparatus comprising: a decision unit for deciding whether or not the number of the winning notices received from each game apparatus via the communication network or the number of the game apparatuses sending the winning notice via the communication network reaches a predetermined number; and an end information transmission unit for transmitting the second mode end information via the communication network to all of the game apparatuses in which the drawing unit operates in the second mode when the decision unit decides that the number of winning notices or that of the game apparatuses, reaches the predetermined number. In the present game system, all the arcade game apparatuses simultaneously go into a state where the specified prize is easily won because an operation mode of all the game apparatuses is simultaneously changed to the second mode in which the winning probability of the specified prize is high. Therefore, players are easy to win the specified prize during the operation in the second mode. As a result, the number of players who are awarded the specified prize and the number of bystanders who see the player winning the specified prize increase, so that the effect of attracting the players by providing the specified prize is improved. On the one hand, if the second mode stays for all time, the number of players who is awarded the specified prize and the number of bystanders who see the player winning the specified prize increase, but it is too easy to win the specified prize. As a result, the willingness of the players to win the specified prize decreases, whereby, on the contrary, the effect of attracting the players by the specified prize decreases. Therefore, in the present game system, where the number of the winning notices received from each of the game apparatuses via a communication network or the number of the game apparatuses sending the winning notice received via the communication network (hereinafter, these numbers are called "the won number") reaches a predetermined number, the operation mode of the drawing unit is changed to the first mode in which the winning probability of the specified prize is low. As a result, in the present game system, players who can actually win the specified prize as a benefit that the specified prize is easily won in the second mode, are limited to a part of all the players who are playing the game during the operation in the second mode. Concretely, they are limited to players who win the prize until the number of times a prize is awarded reaches the predetermined number. Therefore, by setting the predetermined number appropriately, the number of players who win the specified prize, and the number of bystanders who see the player winning the specified prize can be increased, in extent to which the willingness of the players to win the specified prize can be kept up, so that the effect of attracting them can be improved.

In addition, in the game system, each of the game apparatuses may include: a bet object receiving unit for receiving a bet-object(s); and a payout processing unit for executing a payout process to pay out a predetermined amount of payout-objects to a player based on a result of a game, the progression of which is controlled by the game progression control unit, on the condition the bet object receiving unit receives the bet-object, wherein the amount of payout-objects that a player receives in case the winning of the specified prize is decided may be set more than that in case the winning of the specified prize is not decided, and wherein each game apparatus may further include a payout ratio adjusting unit for carrying out a control so as to make a payout ratio, which is a ratio of the amount of payout-objects paid out by the payout processing unit in a predetermined period to the amount of bet-objects the bet object receiving unit receives in the above-mentioned predetermined period, close to a predetermined preset payout ratio. In an arcade game apparatus, it is important to make the payout ratio close to a target ratio. Therefore, generally, the progression of the game in each game apparatus is controlled and adjusted in advance so that the payout ratio statistically converges to the target ratio, in order to make the payout ratio close to the target ratio. In the present game system, at a predetermined timing, all of the game apparatuses go into the second mode simultaneously so that the winning probability of the specified prize becomes high. Even in this case, if the timing of changing the mode to the second mode and the above-mentioned predetermined number is fixed, it is possible to in advance adjust the way of controlling the progression of the game in each game apparatus so that the payout ratio statistically converges to the target ratio. However, a frequency of satisfying a predetermined drawing start condition in each game apparatus during the operation in the second mode changes depending on the number of players and a play style of the players (for example, a play style in which a lot of bet-objects are used for a short term, a play style in which a few bet-objects are used), so that it is difficult to predict this frequency. Therefore, a probability of decision to award the specified prize in the each game apparatus during the operation in the second mode cannot be specified with high precision. As a result, it is difficult to appropriately control the progression of the game in each game apparatus so that the payout ratio statistically converges to the target ratio. Therefore, in the present game system, each game apparatus is provided with the payout ratio adjusting unit, thereby a practical payout ratio in the predetermined period is controlled so as to become close to the predetermined preset payout ratio. Thereby, the payout ratio is adjusted in consideration of an amount of the payout-objects which are actually paid out. As a result, even if the winning probability of the specified prize in each game apparatus during the operation in the second mode is unknown, it is possible to make the payout ratio close to the target ratio (the predetermined preset payout ratio). Furthermore, in the present game system, even if the timing of changing the operation mode to the second mode or the above-mentioned predetermined number can be changed, it is possible to make the payout ratio close to the target ratio (the predetermined preset payout ratio). Therefore, it is easy to realize a flexible system such that the timing of changing the mode to the second mode or the above-mentioned predetermined number can be changed.

As another aspect of the present invention, a game system includes: a plurality of arcade game apparatuses; and a management apparatus connected with these arcade game apparatuses via a communication network, wherein each game apparatus includes: a drawing unit for carrying out a jackpot game to decide a winner who is awarded a jackpot prize when a predetermined drawing start condition is satisfied; a game progression control unit for controlling progression of a game utilizing the drawing unit; a payout amount storage unit for storing payout amount data including an amount of payout-objects to be paid out to a player when the drawing unit decides a winner of the jackpot prize; a jackpot payout processing unit for executing, when the drawing unit decides a winner of the jackpot prize, a first jackpot payout process in which the amount of payout-objects, which is at least part of an amount indicated by the payout amount data read from the payout amount storage unit, is paid out to the awarded player or a second jackpot payout process in which the amount of payout-objects, which is more than the amount of payout-objects paid out by the first jackpot payout process, is paid out to the awarded player; a payout-amount increasing unit for increasing cumulatively an amount indicated by the payout amount data stored in the payout amount storage unit whenever a predetermined payout amount increasing condition is satisfied; a mode changing unit for changing an operation mode of the jackpot payout processing unit between a first mode for executing the first jackpot payout process and a second mode for executing the second jackpot payout process; and a winning notice unit for sending a winning notice to the management apparatus via the communication network when the drawing unit decides a winner of the jackpot prize while the second mode is operated, wherein the mode changing unit of each game apparatus changes the operation mode of the jackpot payout processing unit to the second mode at the same time in each game apparatus and changes the operation mode of the jackpot payout processing unit to the first mode when a second mode end information is received from the management apparatus via the communication network while the second mode is operated, and wherein the management apparatus includes: a decision unit for deciding whether or not the number of the winning notices received from each game apparatus via the communication network or the number of the game apparatuses which sends the winning notice received via the communication network reaches a predetermined number; and an end information transmission unit for transmitting the second mode end information via the communication network to all of the game apparatuses in which the jackpot payout processing unit operates in the second mode, when the decision unit decides that the number reaches the predetermined number. In the present game system, the operation mode of all the arcade game apparatuses is simultaneously changed to the second mode, in which an amount of the payout-objects paid out by awarding the jackpot prize is more than that in the first mode. Therefore when it is in the operation of the second mode, even if a player is awarded the jackpot prize immediately after any one of players is awarded the jackpot prize, a payout amount more than that during the operation of the first mode is guaranteed to the player. By the way, an amount of the payout-objects paid out when the jackpot is hit during the operation of the second mode, may be a fixed amount or a changeable amount. As an example of the changeable amount, there is an amount that is calculated by adding a predetermined amount to the payout amount based on the payout amount data or multiplying the payout amount by a predetermined ratio. In either case, if an amount of the payout-objects paid out when the jackpot prize is awarded during the operation of the second mode is set to a lot, the number of players who are awarded a great number of the payout-objects when the jackpot prize is awarded, and the number of bystanders who see the player winning the jackpot prize increase, so that the effect of attracting them by utilizing the jackpot game is improved. On the one hand, if the second mode stays for all time, the number of players to whom a great number of the payout-objects are awarded, and the number of bystanders who see the player winning the jackpot prize increase, but it becomes difficult to manage a payout ratio, thereby it is difficult to practically use. Therefore, in the present game system, where the won number reaches the predetermined number, the operation mode of the jackpot payout processing unit is changed to the first mode in which the first jackpot payout process, that is, the normal amount process based on the payout amount data, is executed. As a result, in the present game system, players who can receive a benefit that a payout amount more than that during the operation of the first mode is guaranteed when the jackpot prize is awarded, are limited to a part of all the players who are playing during the operation in the second mode. Concretely, they are limited to players who become winners of the jackpot prize until the won number reaches the predetermined number. Therefore, by setting the predetermined number appropriately, the number of players who receive a great number of the payout-objects by the winning of the jackpot prize and the number of bystanders who see the player winning the jackpot prize can be increased in extent to which the payout ratio can be sufficiently managed, so that the effect of attracting them by utilizing the jackpot game can be improved.

Furthermore, as another aspect of the present invention, it is listed that a game system, includes: a plurality of arcade game apparatuses; and a management apparatus connected with these arcade game apparatuses via a communication network, wherein each of the game apparatuses includes: a drawing unit for carrying out a jackpot game to decide a winner who is awarded a jackpot prize when a predetermined drawing start condition is satisfied; a game progression control unit for controlling progression of a game utilizing the drawing unit; a payout amount storage unit for storing payout amount data including an amount of payout-objects to be paid out to a player when the drawing unit decides a winner of the jackpot prize; a jackpot payout processing unit for executing, when the drawing unit decides a winner of the jackpot prizes, a first jackpot payout process in which if an amount indicated by the payout amount data read from the payout amount storage unit is a predetermined upper limit or less, payout-objects, the amount of which is the amount indicated by the payout amount data, are paid out to the awarded player and if the amount indicated by the payout amount data is more than the predetermined upper limit, payout-objects, the amount of which is equal to the upper limit, are paid out to the awarded player or a second jackpot payout process in which payout-objects, the amount of which is equal to the upper limit, are paid out to the awarded player; a payout-amount increasing unit for increasing cumulatively an amount indicated by the payout amount data stored in the payout amount storage unit whenever a predetermined payout amount increasing condition is satisfied; a mode changing unit for changing an operation mode of the jackpot payout processing unit between a first mode for executing the first jackpot payout process and a second mode for executing the second jackpot payout process; and a winning notice unit for sending a winning notice to the management apparatus via the communication network when the drawing unit decides a winner of the jackpot prize while the second mode is operated, wherein the mode changing unit of each of the game apparatuses changes the operation mode of the jackpot payout processing unit to the second mode at the same timing among each game apparatus and changes the operation mode of the jackpot payout processing unit to the first mode when a second mode end information is received from the management apparatus via the communication network while the second mode is operated, and wherein the management apparatus includes: a decision unit for deciding whether the number of the winning notices received from each of the game apparatuses via the communication network or the number of the game apparatuses sending the winning notice received via the communication network reaches a predetermined number or not; and a end information transmission unit for transmitting the second mode end information via the communication network to all of the game apparatuses in which the jackpot payout processing unit operates in the second mode when the decision unit decides to reach the predetermined number. In the present game system, the upper limit of a payout amount paid out during the operation of the first mode is guaranteed as an amount of the payout-objects paid out on the condition that the jackpot prize is awarded, even during the operation of the second mode. Therefore, players who become a winner of the jackpot prize during the operation of the second mode is always able to experience to obtain the maximum amount of payout-objects paid out during the operation of the first mode, thereby this winning of the jackpot prize can be seen by others.

In addition, in the above-mentioned game system, each game apparatus may includes a bet object receiving unit for receiving a bet-object, a payout processing unit for executing a payout process to pay out a predetermined amount of payout-objects to a player based on a result of a game, the progression of which is controlled by the game progression control unit, on the condition that the bet object receiving unit receives the bet-object, and a payout ratio adjusting unit for carrying out a control such that a payout ratio, which is a ratio of a amount of payout-objects paid out by the payout processing unit in a predetermined period to a amount of bet-objects received by the bet object receiving unit in the above-mentioned predetermined period, is close to a predetermined preset payout ratio. It is important for arcade game apparatuses to close the payout ratio to a target ratio. Therefore, generally, a content of controlling the progression of the game in each game apparatus is previously adjusted so that the payout ratio statistically converges to the target ratio for closing the payout ratio to the target ratio. In the present game system, when a predetermined timing comes, all of the game apparatuses become the second mode simultaneously and an amount of payout-objects paid out by the winning of the jackpot prize is more than that in the first mode. In the case, if the timing of changing to the second mode and the above-mentioned predetermined number is fixed, it is possible to previously adjust the content of controlling the progression of the game in each game apparatus so that the payout ratio statistically converges to the target ratio. However, a frequency that the predetermined drawing start condition is satisfied in the each game apparatus during the operation in the second mode changes by the number of players and a play style (for example, a play style that a lot of bet-objects are used for a short term, a play style that bet-objects are used little) of players, thereby it is difficult to predict this frequency. Therefore, a probability of decision to be awarded the jackpot prize in the each game apparatus during the operation in the second mode cannot be specified with high precision. As a result, it is difficult to appropriately adjust the content of controlling the progression of the game in each game apparatus so that the payout ratio statistically converges to the target ratio. Therefore, in the present game system, the each game apparatus is provided with the payout ratio adjusting unit, thereby a practical payout ratio in the predetermined period is controlled so as to close to the predetermined preset payout ratio. Thereby, the practical payout ratio is adjusted in consideration of an amount of the payout-objects paid out practically. As a result, even if the probability of decision to be awarded the jackpot prize in the each game apparatus during the operation in the second mode is unknown, it is possible that the payout ratio closes to the target ratio (the predetermined preset payout ratio). Furthermore, in the present game system, even if the timing of changing to the second mode or the above-mentioned predetermined number can be changed, it is possible that the payout ratio closes to the target ratio (the predetermined preset payout ratio). Therefore, it is easily realized a flexible system such that the timing of changing to the second mode or the above-mentioned predetermined number can be changed.

In addition, in the above-mentioned game system, the mode changing unit of each game apparatus may change the operation mode of the drawing unit to the first mode when the drawing unit decides the winning of the specified prize in the second mode. In the present game system, it is possible to limit to the number of times won during the operation of the second mode in the each game apparatus.

In addition, in the above-mentioned game system, the number of the above-mentioned game apparatuses may be four or more, the decision unit of the management apparatus may total the number of the winning notices received from each game apparatus via the communication network or the number of the game apparatuses sending the winning notice via the communication network, in each of two or more groups, which are respectively composed of two or more game apparatuses, and decides whether or not the totaled number in each group reaches a predetermined number that is determined for each group, and when the decision unit decides that the number of the winning notices or the number of the game apparatuses reaches the predetermined number, the end information transmission unit of the management apparatus may transmit the second mode end information via the communication network to all of the game apparatuses that belong to the group related to the decision of the decision unit. In the present game system, the change from the second mode to the first mode on the condition that the number of the winning notices or the number of the game apparatuses sending the winning notice reaches the predetermined number is carried out at every group, not the whole of the game apparatuses that constitute the present game system. Therefore, it is possible to improve a flexibility of a system management. Concretely, by a way of the system management, there is the case where the winnings of the specified prize during the operation of the second mode concentrate on a part of the game apparatuses, thereby a case where the specified prize cannot be won during the operation of the second mode in other game apparatuses is able to be caused. For example, in game apparatuses at which a net working rate about being played by players during the operation of the second mode is relatively low (for example, game apparatuses installed in a game facility at which customers are a few), the number of the drawings normally becomes less than the case of game apparatuses at which the net working rate is relatively high (for example, game apparatuses installed in a game facility at which customers are a lot). Therefore, until the won number reaches the predetermined number, it can occur that the specified prize is won only in the game apparatuses at which the net working rate is relatively high and the specified prize is not always won in the game apparatuses at which the net working rate is relatively low. In this case, for example, if the game apparatuses that constitute the present game system are divided into a group in which a winning frequency of the specified prize during the operation of the second mode is high and a group in which the winning frequency is low, it is possible to raise the winning frequency of the specified prize during the operation of the second mode even in the game apparatuses in which the winning frequency is low in the case that the game apparatuses do not divided into these groups. Furthermore, for example, if the game apparatuses are divided into groups at every location where each game apparatuses is placed, a local difference is lost and it is possible to give a benefit to win the specified prize during the operation of the second mode equally to all location.

In addition, in the above-mentioned game system, the mode changing unit of each game apparatus may change the mode to the second mode at the same timing as a predetermined date and time or a predetermined time. In the present game system, it is possible to provide an event, such that all of the game apparatuses simultaneously become a state that the specified prize is easily won when the predetermined date and time or a predetermined time comes, on the whole system.

In addition, in the above-mentioned game system, if the drawing relating to the predetermined drawing start condition satisfied before receipt of the second mode end information is not finished yet, the mode changing unit of each game apparatus may change the operation mode to the first mode after the end of this drawing, when the second mode end information is received in the second mode. In the present game system, it is possible to prevent a situation where a player who satisfies the predetermined drawing start condition cannot take a benefit by the second mode in which the specified prize is easily won.

Furthermore, as another aspect of the present invention, a game apparatus that is connected with a management apparatus via a communication network includes: a drawing unit for carrying out a drawing to decide whether or not a specified prize is won in accordance with a predetermined winning probability when a predetermined drawing start condition is satisfied; a game progression control unit for controlling progression of a game utilizing the drawing unit; a mode changing unit for changing an operation mode of the drawing unit between a first mode and a second mode wherein a winning probability of the specified prize in the first mode is lower than that in the second mode; and a winning notice unit for sending a winning notice to the management apparatus via the communication network when the drawing unit decides a winning of the specified prize in the second mode, wherein the mode changing unit changes the operation mode of the drawing unit to the second mode at a predetermined timing and changes the operation mode of the drawing unit to the first mode when the mode changing unit receives a second mode end information from the management apparatus via the communication network in the second mode. In the present game apparatus, by collaboration with the management apparatus, the number of players who experiences to win the specified prize and the number of bystanders who see the player winning the specified prize can be increased within an extent that the willingness of players to win the specified prize can be kept up, so that the effect of attracting players by utilizing the specified prize can be improved.

Furthermore, as another aspect of the present invention, a game apparatus that is connected with a management apparatus via a communication network includes: a drawing unit for carrying out a jackpot game to decide a winner who is awarded a jackpot prize when a predetermined drawing start condition is satisfied; a game progression control unit for controlling progression of a game utilizing the drawing unit; a payout amount storage unit for storing payout amount data including information of an amount of payout-objects to be paid out to a player when the drawing unit decides a winner of the jackpot prize; a jackpot payout processing unit for executing, when the drawing unit decides a winner of the jackpot prizes, a first jackpot payout process in which the amount of payout-objects which is at least part of an amount indicated by the payout amount data read from the payout amount storage unit, is paid out to the awarded player or a second jackpot payout process in which the amount of payout-objects which is the amount of payout-objects paid out by the first jackpot payout process or more, is paid out to the awarded player; a payout-amount increasing unit for increasing cumulatively an amount indicated by the payout amount data stored in the payout amount storage unit whenever a predetermined payout amount increasing condition is satisfied; a mode changing unit for changing an operation mode of the jackpot payout processing unit between a first mode for executing the first jackpot payout process and a second mode for executing the second jackpot payout process; and a winning notice unit for sending a winning notice to the management apparatus via the communication network when the drawing unit decides a winner of the jackpot prize while the second mode is operated, wherein the mode changing unit changes the operation mode of the jackpot payout processing unit to the second mode at a predetermined timing and changes the operation mode of the jackpot payout processing unit to the first mode when the mode changing unit receives a second mode end information from the management apparatus via the communication network in the second mode. In the present game apparatus, by collaboration with the management apparatus, the number of players who experiences to obtain a great number of the payout-objects by the winning of the jackpot prize and the number of bystanders who see the player winning the jackpot prize can be increased within an extent that the management of the payout ratio is possible enough, so that the effect of attracting players by utilizing the jackpot game can be improved.

Furthermore, as another aspect of the present invention, a management apparatus that is connected with a plurality of the game apparatuses according to claim 19 via a communication network includes: a decision unit for deciding whether or not the number of the winning notices received from each game apparatus via the communication network or the number of the game apparatuses sending the winning notice via the communication network, reaches a predetermined number; and an end information transmission unit for transmitting a second mode end information via the communication network to each game apparatus when the decision unit decides that the number of the wining notices or the number of the game apparatuses, reaches the predetermined number. In the present management apparatus, by collaboration with a plurality of the arcade game apparatuses, the number of players who experiences to win the specified prize and the number of bystanders who see the player winning the specified prize can be increased within an extent that the willingness of players to win the specified prize can be kept up, or the number of players who experiences to obtain a great number of the payout-objects by the winning of the jackpot prize and the number of bystanders who see the player winning the jackpot prize can be increased within an extent that the management of the payout ratio is possible enough, so that the effect of attracting players by utilizing the jackpot game or the specified prize can be improved, In the above-mentioned management apparatus, the decision unit may total the number of the winning notices received from each game apparatus via the communication network or the number of the game apparatuses sending the winning notice via the communication network, in each of two or more groups, which are respectively composed of two or more game apparatuses, and may decide whether or not the totaled number in each group reaches a predetermined number that is determined for each group, and when the decision unit decides that the number of the winning notices or the number of the game apparatuses reaches the predetermined number, the end information transmission unit may transmit the second mode end information via the communication network to all of the game apparatuses that belong to the group related to the decision of the decision unit. In the present management apparatus, it is possible to improve a flexibility of a management of the game system.

DETAILED DESCRIPTION

Hereinafter, a description is given of one embodiment in which the present invention is applied to a game system composed of a plurality of pusher game machines being token-operated game machine as game apparatuses for business use (arcade game apparatuses) and a management server as a management apparatus connected with these pusher game machines to enable communication, with reference to the drawings. In addition, each of the drawings merely shows the shape, dimensions and positional relationship briefly to such an extent that is helpful in understanding the content of the present invention. The present invention shall not be therefore limited only to the shape, dimensions or positional relationship shown in each of the drawings. Furthermore, in each of the drawings, in order to make a constitution clear, part of the hatching on the cross section is omitted. Still further, a numerical value to be exemplified later is only a preferable example of the present invention, and therefore the present invention shall not be limited to the exemplified numerical value.

Figure 1:
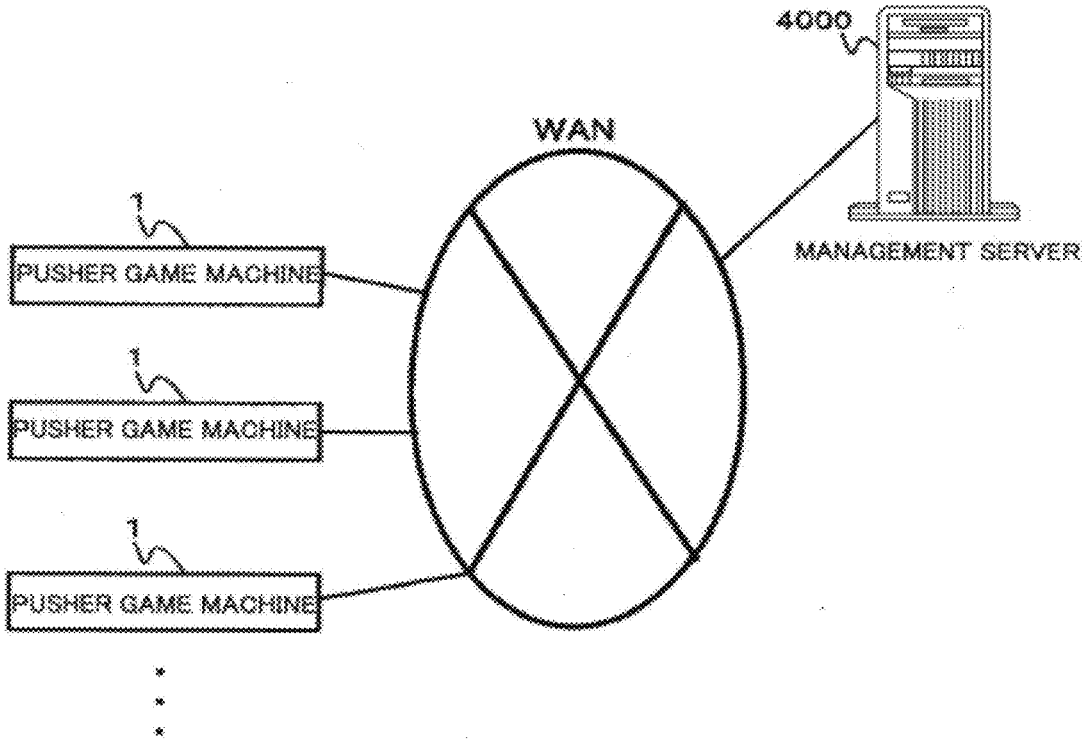
FIG. 1 is a view showing a summary constitution of entire game system according to the embodiment.

(summary of the system) First of all, a description is given of an entire constitution of the game system according to the present embodiment. FIG. 1 is a view showing a summary constitution of the entire game system according to the present embodiment. A plurality of pusher game machines 1 constituting this game system is installed in game facilities (game arcades) such as game centers or the like, where there are different places each other in the present embodiment. The each pusher game machine 1 and the management server 4000 are connected with each other via a WAN (Wide Area Network) as a low speed communication network. The management server 4000 carries out a management of the entire game system by carrying out data communications with each pusher game machine 1. In addition, in the present embodiment, a description is given of a game system extending over a plurality of game arcades, but a game system in a single game arcade is similar.

Figure 2:
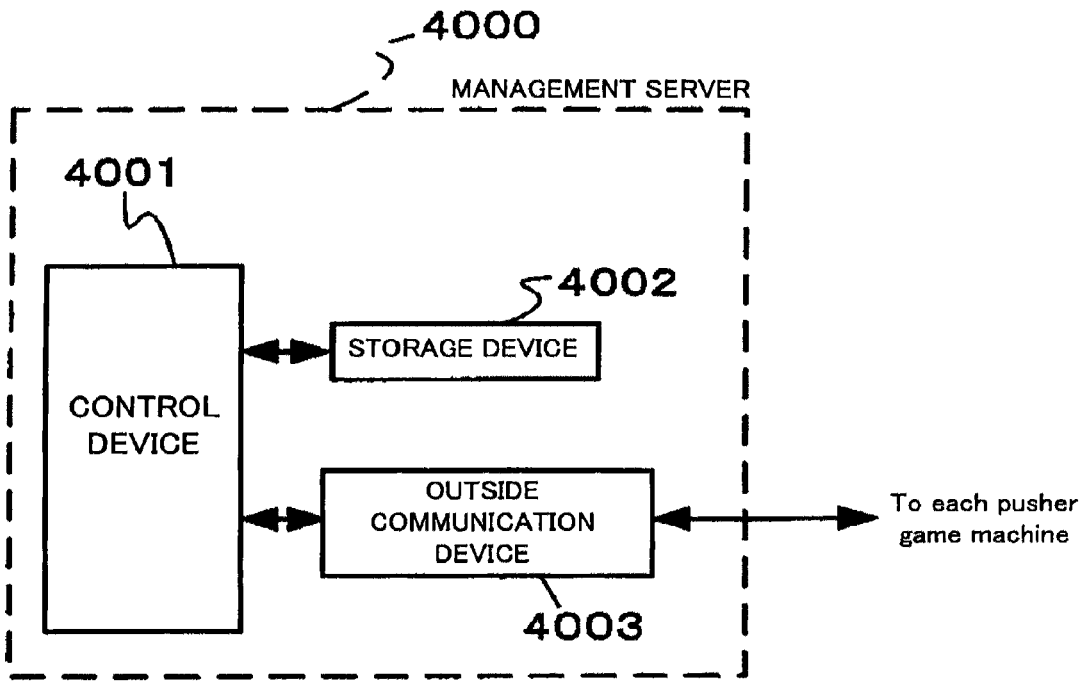
FIG. 2 is a block diagram relating to a control of a management server.
Figure 3:
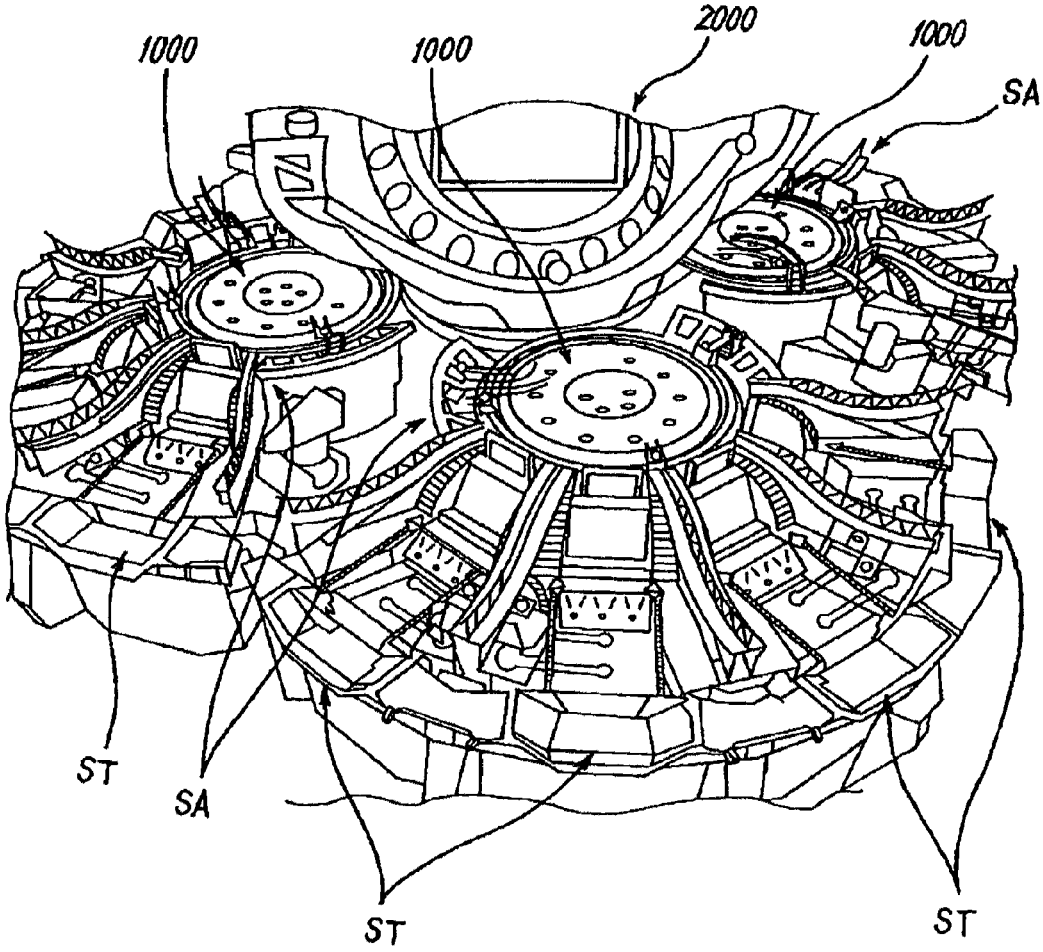
FIG. 3 is a partial perspective view showing an entire constitution of the pusher game machine.

(Constitution of management server) FIG. 2 is a block diagram relating to a control of the management server 4000. The management server 4000 mainly includes a control device 4001 as a decision unit functioning as decision means and an end information transmission unit functioning as end information transmission means, a storage device 4002 and an outside communication device 4003. The storage device 4002 stores control programs of various kinds. The outside communication device 4003 is for carrying out data communications with each pusher game machine 1 via the WA (Constitution of entire game machine) FIG. 3 is a partial perspective view showing an entire constitution of a pusher game machine 1 according to the present embodiment. The pusher game machine 1 is provided with four satellite units SA so as to surround a center drawing device 2000. Each of the satellite units SA is provided with four station units ST so that each player can play at the respective station units ST. Further, each of the satellite units SA is provided with one satellite drawing device 1000 as physical drawing means, and the respective station units ST are arranged in juxtaposition around the satellite drawing device 1000.

Figure 4:
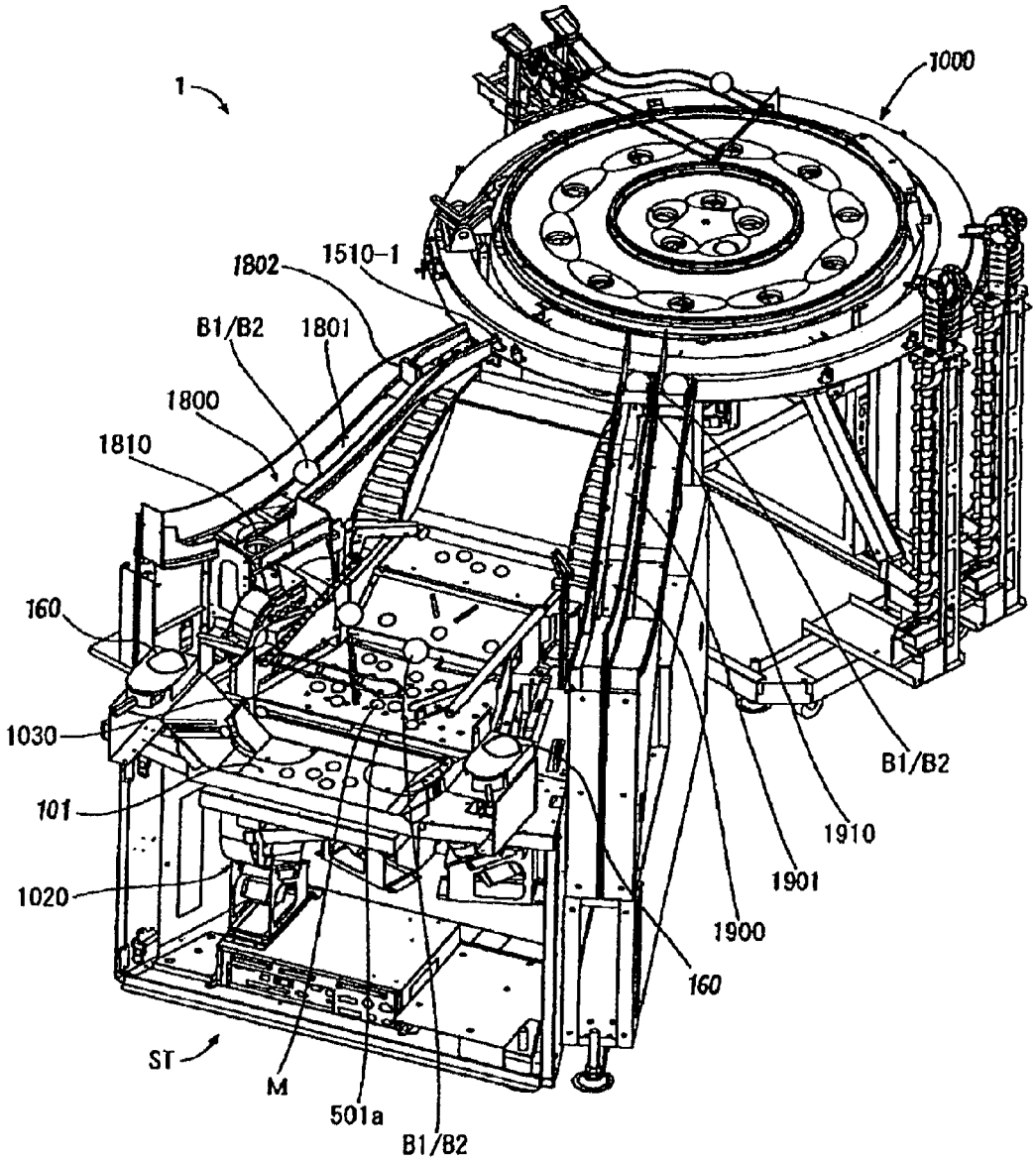
FIG. 4 is an explanatory view for explaining a constitution of a station unit in the pusher game machine.
Figure 5:
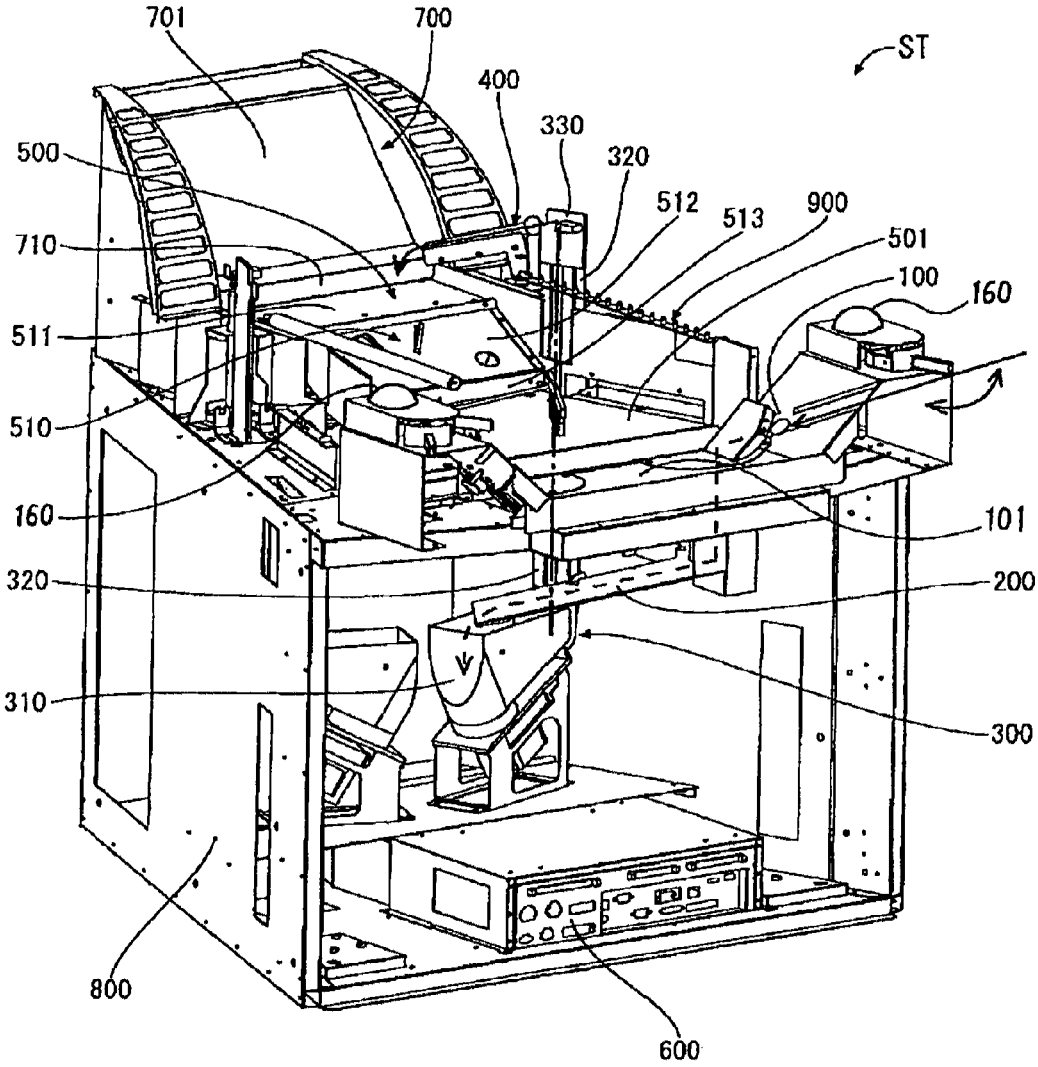
FIG. 5 is an explanatory view for explaining an internal structure of the station unit.

(Constitution of station unit) FIG. 4 is an explanatory view for explaining a constitution of the station unit ST in the pusher game machine 1. FIG. 5 is an explanatory view for explaining an internal structure of the station unit ST. As shown in FIG. 5, the station unit ST includes a token inserting mechanism (inserting unit) 100, a token transfer channel 200, a lift-up hopper 300, token discharge channel 400, a play field 500, a control unit 600, a display unit 700, and a cabinet 800. In the present embodiment, a token sending-out unit functioning as token sending-out means is mainly composed of the token inserting mechanism (inserting unit) 100, the token transfer channel 200, the lift-up hopper 300 and the token discharge channel 400.

The cabinet 800 has a constitution that forms a framework of the station unit ST. In the cabinet 800, the token inserting mechanism 100 is arranged on the upper front side, and the display unit 700 as display means is arranged on the upper backside, and the play field 500 is arranged at the upper center. Further, the token transfer channel 200, the lift-up hopper 300, the control unit 600 and others are accommodated inside the cabinet 800. Herein, "front side" means a side at which a player is positioned during a game, "back side" means a side opposite to the side at which a player is positioned during a game and "center" means a region between the above-described "front side" and "back side."

The token inserting mechanism 100 has a constitution in which a player inserts tokens M into the pusher game machine 1 during a game. The tokens M inserted from the token inserting mechanism 100 are transferred via the token transfer channel 200 to the lift-up hopper 300 and stored temporarily at the lift-up hopper 300. The token transfer channel 200 and the lift-up hopper 300 are, as described above, arranged in the cabinet 800. In addition, the token transfer channel 200 has functions to mechanically and physically connect the token inserting mechanism 100 and the lift-up hopper 300, and to transfer the tokens M inserted from the token inserting mechanism 100 to the lift-up hopper 300.

The lift-up hopper 300 includes a token storing unit 310 for storing tokens M, a lift-up unit 320 for lifting up the tokens M to a predetermined height, and a token discharge unit (discharge unit) 330 for discharging the thus lifted up tokens M at a predetermined timing. Further, a token discharge channel 400 for guiding the thus discharged tokens M to the play field 500 is provided with a discharge port of the token discharge unit 330 so as to sway in the lateral direction.

The upper end of the lift-up unit 320 is arranged above the play field 500. Accordingly the token discharge unit 330 provided with the upper end of the lift-up unit 320 is also arranged above the play field 500. As a result, the tokens M temporarily stored at the token storing unit 310 arranged below the play field 500 are lifted up above the play field 500 by the lift-up unit 320, and thereafter discharged from the token discharge unit 330 via the token discharge channel 400 into the play field 500.

A main table 501 as a token placed base for storing tokens M in a valid state and a pusher unit 510 as a token pushing-out member placed on the main table 501 are arranged inside the play field 500. In addition, the valid state means a state that is involved in the game. The pusher unit 510 includes an upper face for storing the tokens M in a valid state (which is referred to as a sub-table 511), an sloping table 512 on which the tokens M dropped from the sub-table 511 slide, and a pushing wall 513 for pushing the tokens M stored on the main table 501. Further, the pusher unit 510 is arranged on the main table 501 in the play field 500 so as to slide, and moves back and forth in a sliding manner with a constant cycle or any given cycle. Part (a back side) of the pusher unit 510 is accommodated in an accommodating unit 720 to be described later, which is arranged below the display unit 700. The pusher unit 510 slides in such a manner as to enter into and leave from the accommodating unit 720, thereby reciprocates back and forth.

A frame member 710 of a display 701 in the display unit 700 is in contact with the sub-table 511 so as to slide thereon. Therefore, where the pusher unit 510 moves to a direction at which it is accommodated into the accommodating unit 720, tokens M on the sub-table 511 are pushed by the frame member 710. This push allows part of the tokens M on the sub-table 511 to drop on the sloping table 512. Part of the tokens M dropped from the sub-table 511 enters into openings (which are referred to as chuckers 515-1, 515-2 and 515-3) as a token passage opening arranged on the sloping table 512. Further, remaining tokens M are dropped to the main table 501, as they are, and stored on the main table 501.

The tokens M on the main table 501 are pushed by a sliding movement of the pusher unit 510 in the same way as the tokens M on the sub-table 511. In other words, since the pusher unit 510 is placed on the main table 501 without any clearance, upon movement of the pusher unit 510 to a direction at which it moves out from the accommodating unit 720, the tokens M on the main table 501 are pushed by the pushing wall 513 that is the front face of the pusher unit 510. This push allows part of the tokens M on the main table 501 to drop. Of the thus dropped tokens M, the tokens M dropped from the end on the side of a player (which is referred to as a front end 501*a* (refer to FIG. 4)) into a token dropping groove are paid out to the player, whereas other tokens M, for example, tokens M dropped from either side of the main table 501 (which are referred to as a side end 501*b*) are stocked at a predetermined storing unit in the station unit ST.

Further, the tokens M inserted from the token inserting mechanism 100 are temporarily stocked at the token storing unit 310 in the lift-up hopper 300. The tokens M stocked at the token storing unit 310 are lifted up by the lift-up unit 320 and preset at the token discharge unit 330 of the lift-up hopper 300. When the tokens M are inserted into the token inserting mechanism 100, the lift-up hopper 300 discharges into the play field 500 the tokens M preset at the token discharge unit 330 in accordance with control from the control unit 600. As described above, in the present embodiment, the tokens M inserted from a player are different from the tokens M actually inserted into the play field 500.

In addition, as shown in FIG. 4, the station unit ST is provided with a ball inserting mechanism 1800 at least on either side. The ball inserting mechanism 1800 has a constitution for inserting into the play field 500 a ball B1 or B2 that are spherical objects as foreign shape objects to be described later. The ball inserting mechanism 1800 is provided with a ball inserting slope 1801 and a ball-inserting-position-drawing-mechanism 1810. In addition, the balls B1 and B2 are drawing objects for carrying out a bingo game to be described later.

Further, as shown in FIG. 4, the station unit ST is provided with a ball conveying mechanism 1900 at least on either side. The ball conveying mechanism 1900 has a constitution for conveying the ball B1 or B2 to the satellite drawing device 1000 when the ball B1 or B2 falls from the main table 501 in the play field 500 into the token dropping groove arranged on the front side thereof. The ball conveying mechanism 1900 is provided with a ball transfer channel 1040 and a ball conveying unit 1910 and a ball-conveying-unit-running-slope 1901 to be described later. The ball transfer channel 1040 is arranged below the front end 501*a*, thereby guiding the ball B1 or B2 fallen from the front end 501*a* to the ball conveying unit 1910. The ball conveying unit 1910 has a constitution for conveying the ball B1 or B2 received via the ball transfer channel 1040 to the satellite drawing device 1000. The ball conveying unit 1910 runs on the ball-conveying-unit-running-slope 1901 in accordance with control of the control unit 600. In addition, the ball B1 or B2 conveyed to the satellite drawing device 1000 is delivered to the ball carrier 1520 to be described later (refer to FIG. 8).

Still further, as shown in FIG. 4, the station unit ST is provided with a token payout mechanism including a lift-up hopper 1020 and a token payout unit 1030. Driving the token payout mechanism, tokens M as many as the tokens M dropped from the front end 501*a* to the token dropping groove are discharged into a storing portion 101 of the token inserting mechanism 100.

Figure 6:
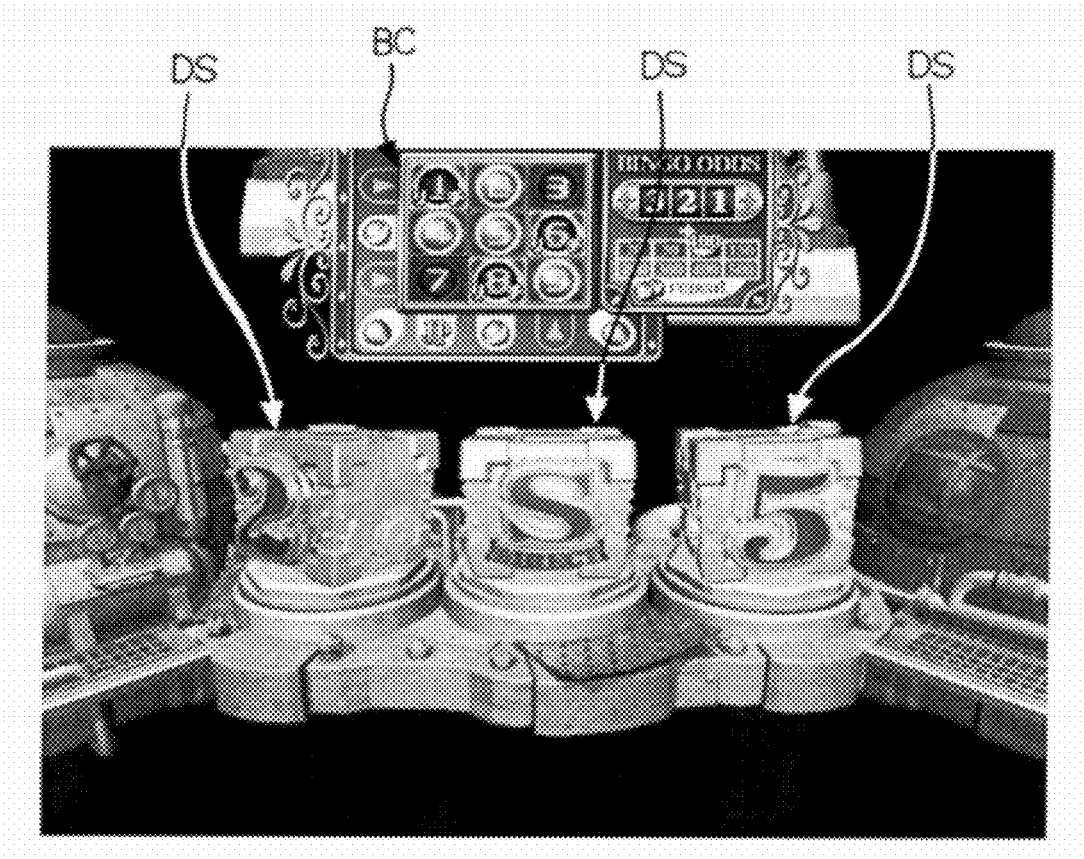
FIG. 6 is an explanatory view showing one example of a slot game screen displayed on a display unit of the station unit.
Figure 7:
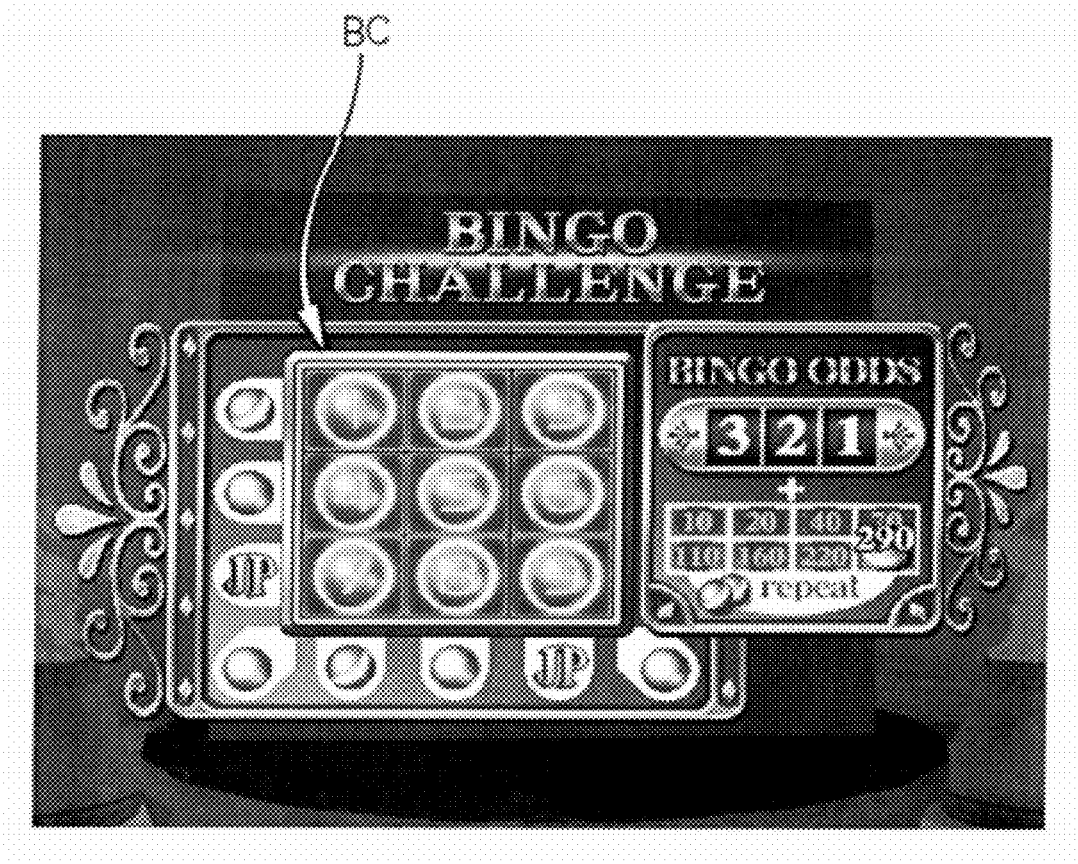
FIG. 7 is an explanatory view showing one example of a bingo game screen displayed on the display unit of the station unit.

In addition, a game screen of games such as a bingo game and a digital drawing game (slot game) different from the pusher game is displayed on the display unit 700 at the station unit ST. In the present pusher game machine 1, as will be described later, besides the pusher game, a slot game screen shown in FIG. 6 is displayed on the display unit 700 and the slot game is carried out. Also, a bingo game screen shown in FIG. 7 is displayed on the display unit 700 and the bingo game is carried out.

The slot game is a digital drawing game in which the control unit 600 at the station unit ST mainly carries out a drawing digitally. This slot game is started under the condition that the token M enters into any one of chuckers 515-1, 515-2 and 515-3 arranged on the sloping table 512 at the pusher unit 510. The slot game screen shown in FIG. 6 is displayed on the display unit 700 during a period when the bingo game to be described later does not progress. When the token M enters into any one of the chuckers 515-1, 515-2, 515-3 and thereby the slot drawing start condition is satisfied, the control unit 600 controls to display for rotating three dice-shaped slots DS. In the digital drawing of the slot game, the control unit 600 executes a predetermined drawing program and decides a winning in which any one of specific-combinations is awarded or a non-winning by referring to a predetermined winning table based on generated random number. Thereafter, where a winning combination is decided, the control unit 600 controls to display for allowing the display unit 700 to halt the rotation of the three dice-shaped slots DS so as to halt and display a pattern of symbols related to the winning combination.

In the present embodiment, as the specific-combinations of the digital drawing, provided are a minor-combination A in which three tokens are supplied to the play field 500, a minor-combination B in which eight tokens are supplied to the play field 500, a ball supply combination in which the ball B1 is supplied to the play field 500, an normal bonus combination in which thirty tokens are supplied to the play field 500, a probability-change bonus combination in which thirty tokens are supplied to the play field 500 and a winning table at which a winning probability is set to be higher is used in subsequent digital drawings, a direct satellite combination in which the ball B1 is directly supplied to the satellite drawing device 1000, a direct center combination in which the ball B1 is directly supplied to the center drawing device 2000, and others. The winning probability of each of these specific-combinations is set to be lowered in accordance with the above-described order. In addition, which specific-combination is provided or to which winning probability each of the specific-combinations is set is determined arbitrarily. For example, various benefits such as direct payment of tokens M are given to a player.

In the present embodiment, the control unit 600, which is a supply drawing unit, functions as supply drawing means, decides whether a ball supply combination is awarded or not, thereby carrying out a drawing whether the ball B1 is supplied to the play field 500 or not. Then, when the ball supply combination is awarded by the digital drawing of the control unit 600, the control unit 600 outputs a ball supply order to a control unit (not illustrated) of the satellite drawing device 1000. Thereby, the control unit of the satellite drawing device 1000 delivers, as will be described later, the ball B1 from a ball supply mechanism 1300 to the ball carrier 1520, by which the ball carrier 1520 is moved along the outer circumference of an annular ball transfer channel 1500 to a corresponding position of the station unit ST at which the ball supply combination is awarded. After that, the ball B1 is delivered from the ball carrier 1520 to the ball inserting mechanism 1800 of the station unit ST, and the ball B1 is supplied from the ball inserting mechanism 1800 to the play field 500. In addition, in the present embodiment, the ball B2 is supplied to the play field 500 only when BINGO of a specific line on a bingo card is established in the bingo game to be described later. A constitution and movements related to thus ball supply are substantially similar to those of the ball B1 excluding the fact that the ball B2 is delivered from a ball supply mechanism 1400 different from the ball supply mechanism 1300 to the ball carrier 1520. In the present embodiment, as described above, a constitution for supplying the ball B1 or B2 to the play field 500 composed of a foreign-shape-object-supplying-unit which functions as foreign-shape-object-supplying-means.

The bingo game is a physical drawing game which is progressed by a physical drawing using two types of balls B1, B2 and the satellite drawing device 1000. The bingo game is allowed to progress by a control unit (not illustrated) of the satellite drawing device 1000 to be described later and the control unit 600 of the station unit ST. In addition, in the bingo game, the control unit of the satellite drawing device 1000 mainly controls a drawing for deciding the winning bingo numbers of the bingo game. The control unit 600 of each of the station units ST belonging to the satellite unit SA including the satellite drawing device 1000 is mainly in charge of controlling the performance of the bingo game and the judgment of the establishment of BINGO. In the present embodiment, the ball B1 or B2 is moved by the satellite drawing device 1000, by which such a physical drawing is carried out that one winning bingo number (a winning object) is selected from a plurality of mutually different bingo numbers (drawing objects). In the physical drawing of the present embodiment, one winning bingo number is selected from the bingo numbers of "1" through "9." Then, pattern information of the bingo card at which these bingo numbers of "1" through "9" are arrayed in a matrix form is generated individually for each of the station units ST by the control unit 600 as a pattern-information generating unit which functions as pattern-information generating means for the station unit ST. Thereafter, a bingo card image BC in which images of the bingo numbers of "1" to "9" (drawing object images) are arrayed according to the pattern information is, as shown in FIG. 7, displayed on the display unit 700 of each of the station units ST. In the present embodiment, while the bingo game does not progress, the slot game screen shown in FIG. 6 is displayed on the display unit 700, and when a physical drawing of the bingo game is started, it is changed to the bingo game screen shown in FIG. 7. In addition, on completion of the physical drawing of the bingo game, the screen is again returned to the slot game screen. However, the bingo card image BC is displayed to be small at the upper part on the slot game screen as shown in FIG. 6. Therefore, a player is able to constantly confirm how many winning bingo numbers are obtained on the bingo card of the station unit ST that a player plays.

In the present embodiment, each of the bingo games carried out at each station is usually executed independently for each station unit ST. In other words, where the ball B1 or B2 falls on the token dropping groove at one station unit ST to start the physical drawing in the satellite drawing device 1000, a bingo number that is drawn thereby is handled as a winning bingo number only at the one station unit ST and not handled as a winning bingo number at other station units ST. However, in the present embodiment, where a predetermined event condition to be described later is satisfied, a bingo number which is drawn by the physical drawing carried out when the ball B1 or B2 falls on the token dropping groove of one station unit ST is handled as a winning bingo number not only at the one station unit ST but also at other station units ST as well.

In this instance, these other station units ST in the present embodiment are three remaining station units ST belonging to the satellite unit SA to which the above one station unit ST also belongs. In other words, in the present embodiment, all the station units ST provided in the present pusher game machine 1 are divided into a plurality of groups, each of which is given as the satellite unit SA, and the above event condition is satisfied between the station units ST belonging to the satellite unit SA, thereby developing a state that the game of each player is mutually related. As a result, a game attractiveness, for example, that players who play at station units ST belonging to the same satellite unit SA cooperate with each other to obtain tokens is created. Other details of the bingo game according to the present embodiment will be described later.

Figure 8:
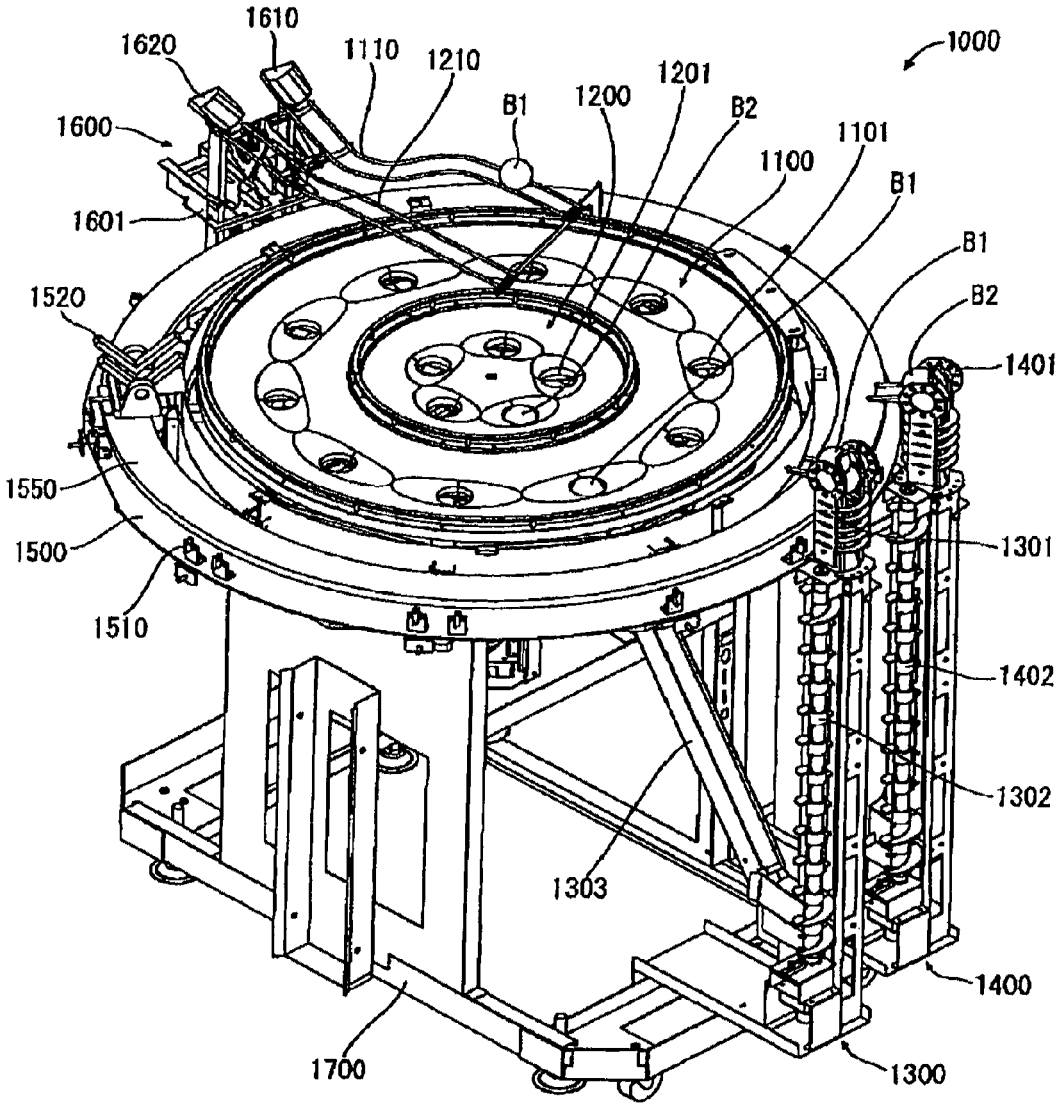
FIG. 8 is a perspective view showing a major constitution of a satellite drawing device in the pusher game machine.

(Constitution of satellite drawing device) FIG. 8 is a perspective view showing a major constitution of the satellite drawing device 1000. The satellite drawing device 1000 includes an outer bingo stage 1100, an inner bingo stage 1200, the ball supply mechanisms 1300 and 1400, the ball transfer channel 1500, a stage-ball-inserting-mechanism 1600 and a supporting base 1700.

The supporting base 1700 has a constitution acting as a framework of the satellite drawing device 1000, and supporting other constitutions thereof. The inner bingo stage 1200 is arranged at the upper center of the supporting base 1700. The outer bingo stage 1100 is arranged so as to surround the inner bingo stage 1200. Further, the ball transfer channel 1500 is arranged so as to surround the outer bingo stage 1100. The ball supply mechanisms 1300 and 1400 are arranged at the side of the ball transfer channel 1500.

The ball supply mechanism 1300 has a constitution for supplying a certain type of ball, for example, a non-metal ball B1. On the other hand, the ball supply mechanism 1400 has a constitution for supplying a type of ball different from the ball B1, for example, a metal ball B2. In addition, a difference between the ball B1 and the ball B2 may be defined by other factors, for example, the color of the ball, not depending on whether it is a metal ball or a non-metal ball.

The ball supply mechanism 1300 includes a ball supply unit 1301, a lift-up unit 1302, and a ball returning channel 1303. The ball supply unit 1301 has a constitution for supplying the ball B1 to the ball carrier 1520 to be described later. The lift-up unit 1302 has a constitution for lifting up the ball B1 up to the ball supply unit 1301. The ball returning channel 1303 has a constitution acting as a channel for returning the ball B1 supplied to the outer bingo stage 1100 to be described later to the lift-up unit 1302 in the ball supply mechanism 1300.

Similarly, the ball supply mechanism 1400 includes a ball supply unit 1401, a lift-up unit 1402 and a ball returning channel (not illustrated). The ball supply unit 1401 has a constitution for supplying the ball B2 to the ball carrier 1520 to be described later. The lift-up unit 1402 has a constitution for lifting up the ball B2 to the ball supply unit 1401. The ball returning channel (not illustrated) has a constitution acting as a channel for returning the ball B2 supplied to the inner bingo stage 1200 to be described later to the lift-up unit 1402 in the second ball supply mechanism 1400.

The ball carrier 1520 has a constitution for conveying the ball B1 or B2 along the outer circumference of the annular ball transfer channel 1500. The ball carrier 1520 is provided with a receiving unit composed of two bar-like members bent in a V letter shape, by which the ball B1 or B2 are retained. Further, the ball carrier 1520 is fixed to a ring-shaped member 1550 arranged along the ball transfer channel 1500. Therefore, the ring-shaped member is rotated along the ball transfer channel 1500, by which the ball carrier 1520 moves along the ball transfer channel 1500.

The ball transfer channel 1500 is provided on the outer circumferential face with a plurality of sensor units 1510. The sensor units 1510 has a constitution for detecting whether the ball carriers 1520 are present in the closest vicinity thereof. Information detected by the sensor units 1510 is input, for example, into a control unit (not illustrated) whenever necessary or on real time basis. This control unit specifies a position of the ball carrier 1520 on the basis of information sent from the sensor units 1510, thereby controls the running and halt of the ball carrier 1520. For example, where the ball B1 is supplied to the station unit ST shown in FIG. 4, this control unit allows the ball carrier 1520 to halt at a position of the sensor unit 1510-1 on the basis of information from the sensor units 1510. Thereby, the ball carrier 1520 is positioned on an extension of the ball inserting slope 1801. In this state, when the V letter shaped receiving unit of the ball carrier 1520 is tilted toward the ball inserting slope 1801 by using the control unit (not illustrated), the ball B1 or B2 retained on the ball carrier 1520 are inserted into an inlet of the ball inserting slope 1801 (refer to FIG. 4). In addition, the sensor units 1510 are arranged on the outer circumferential face of the ball transfer channel 1500 and respectively at a position where the ball inserting slope 1801 at individual station units ST is arranged and a position where the ball-conveying-unit-running-slope 1901 is arranged.

The ball B1 or B2 inserted into the ball inserting slope 1801 is temporarily retained by a stopper 1802 shown in FIG. 4. Then, when a player pushes a button 160 and thereby a button operating signal is sent to the control unit 600, the control unit 600 controls for driving the stopper 1802 so as to tilt toward an outlet of the ball inserting slope 1801. Thereby, the ball B1 or B2 retained by the stopper 1802 rolls down due to inclination of the ball inserting slope 1801, and is inserted into the play field 500 via the ball-inserting-position-drawing-mechanism 1810. The ball B1 or B2 which has been inserted into the play field 500 falls, in the same way as tokens M, from the front end 501*a* of the main table 501 to the token dropping groove while the pusher game progresses. The fallen ball B1 or B2 is, as described above, set at the ball conveying unit 1910 via the ball transfer channel 1040 to be described later. In addition, the ball transfer channel 1040 is provided with a ball receiving unit 1041 for receiving only the ball B1 or B2 and allowing the tokens M to pass. Also, the ball conveying unit 1910 is normally on standby at a ball discharge port 1043 of the ball transfer channel 1040.

As described above, the ball conveying unit 1910 has a constitution for conveying the ball B1 or B2 to the satellite drawing device 1000. When the ball B1 or B2 is set, the ball conveying unit 1910 runs up the ball-conveying-unit-running-slope 1901 on the basis of controlling from the control unit (not illustrated), and moves up to the upper end of the ball-conveying unit traveling slope 1901. The ball carrier 1520 is on standby in the vicinity of the upper end of the ball-conveying-unit-running-slope 1901. After the ball conveying unit 1910 has moved to the upper end of the ball-conveying-unit-running-slope 1901, the ball conveying unit 1910 delivers the transferred ball B1 or B2 to the ball carrier 1520. In addition, the ball carrier 1520 to which the ball B1 or B2 has been delivered is in a posture of retaining this.

Further, upon receipt of the ball B1 or B2, the ball carrier 1520 moves to a position facing the stage-ball-inserting-mechanism 1600 on the basis of control from the control unit (not illustrated). The stage-ball-inserting-mechanism 1600 includes a catch pan 1610 for inserting the ball B1 into the outer bingo stage 1100 and a catch pan 1620 for inserting the ball B2 into the inner bingo stage 1200. The ball carrier 1520 moves to a position facing the catch pan 1610 or 1620 depending on a type of the balls (B1, B2) that is retained, on the basis of control from the above-described control unit (not illustrated). Where the catch pan 1610 or 1620 receives the ball from the ball carrier 1520, the catch pan 1610 or 1620 moves down to a position facing the ball carrier 1520. After receipt of the ball from the ball carrier 1520, the catch pan 1610 or 1620 moves up to a position facing the ball inserting channel 1110 or 1210. Then, the catch pan 1610 or 1620 retains the ball until a ball inserting timing.

For example, where the ball B1 is received from the ball conveying unit 1910, the ball carrier 1520 runs along the ball transfer channel 1500 and thereafter delivers the ball B1 to the catch pan 1610 in the stage-ball-inserting-mechanism 1600. The catch pan 1610, which has received the ball B1, inserts the retaining ball B1 into the ball inserting channel 1110, for example, at a timing when a player pushes the button 160. The thus inserted ball B1 is accelerated according to the inclination and length of the ball inserting channel 1110 and thereafter inserted into the outer bingo stage 1100. Further, for example, where the ball B2 is received from the ball conveying unit 1910, the ball carrier 1520 runs along the ball transfer channel 1500 and thereafter delivers the ball B2 to the catch pan 1620 in the stage-ball-inserting-mechanism 1600. The catch pan 1620, which has received the ball B2, inserts the retaining ball B2 into the ball inserting channel 1210, for example, at a timing when a player pushes the button 160. The thus inserted ball B2 is accelerated according to the inclination and length of the ball inserting channel 1210 and thereafter inserted into the inner bingo stage 1200. In addition, whether a type of the ball delivered to the ball carrier 1520 is the B1 or B2 can be detected by mounting a metal sensor on the ball carrier 1520, for example, where the ball B1 is made of a non-metal material and the ball B2 is made of a metal. Further, for example, where a different color is given to the ball B1 and the ball B2, a color sensor or the like is mounted on the ball carrier 1520, thus making it possible to detect a type of the ball. Also, information on the type of the thus detected ball is sent to a control unit (not illustrated). Therefore, the ball carrier 1520 is controlled on the basis of the type of the ball notified to the control unit.

The outer bingo stage 1100 is provided with two or more holes (which are referred to as winning spots 1101) having such a diameter that allows the ball B1 to pass. The outer bingo stage 1100 is rotating around the inner bingo stage 1200 in a predetermined cycle. In the present embodiment, there are a total of ten winning spots 1101 to which bingo numbers of "1" through "9" used in the bingo game and a right for starting a drawing at the center drawing device 2000 are individually allocated. The ball B1 that has been inserted into the outer bingo stage 1100 goes around in the outer bingo stage 1100 by acceleration obtained at the ball inserting channel 1110 and the rotation of the outer bingo stage 1100 itself, and thereafter enters into any one of the winning spots 1101. Information on which of the winning spots 1101 the ball B1 has entered is sent to a control unit (not illustrated) appropriately. When the ball B1 enters into any one of the winning spots 1101 to which bingo numbers are allocated, this control unit decides a bingo number allocated to the winning spot 1101 as a winning bingo number in cooperation with the control unit 600 of the station unit ST from which the ball B1 is transferred, or the like, and progresses the bingo game. In addition, the ball B1 that has entered into the winning spot 1101 is retained temporarily at an inlet of the winning spot 1101 so as to be confirmed by a player and thereafter inserted into the ball returning channel 1303 arranged below the outer bingo stage 1100.

Similarly, the inner bingo stage 1200 is provided with one or more of winning spots 1201 having such a diameter that allows the ball B2 to pass. The inner bingo stage 1200 is rotating in a predetermined cycle around a central pivot thereof. In the present embodiment, there are four winning spots 1201 to which bingo numbers of "1" to "8" used in the bingo game are individually allocated by two each and one winning spot 1201 to which a right for starting the drawing at the center drawing device 2000 is allocated, a total of five winning spots 1201. The ball B2 that has been inserted into the inner bingo stage 1200 goes around in the inner bingo stage 1200 by acceleration obtained at the ball inserting channel 1210 and the rotation of the inner bingo stage 1200 itself, and thereafter enters into any one of the winning spots 1201. Information on which of the winning spots 1201 the ball B2 has entered is sent to the control unit (not illustrated) appropriately. When the ball B2 enters into any one of the winning spots 1201 to which bingo numbers are allocated, this control unit decides bingo numbers allocated to the winning spot 1101 as winning bingo numbers in cooperation with the control unit 600 of the station unit ST from which the ball B2 is transferred, or the like, and progresses the bingo game. In addition, the ball B2 that has entered into the winning spot 1201 is retained temporarily at an inlet of the winning spot 1201 so as to be confirmed by a player and thereafter inserted into a ball returning channel (not illustrated) arranged below the inner bingo stage 1200.

Further, when at the outer bingo stage 1100 or the inner bingo stage 1200, the ball B1 or B2 enters into the winning spots 1101 or 1201 to which the right for starting the drawing at the center drawing device 2000 is allocated, the control unit (not illustrated) of the satellite drawing device 1000 outputs an order for starting a jackpot game to a control unit (not illustrated) of the center drawing device 2000 to be described later. The details of the jackpot game at the center drawing device 2000 will be described later.

Figure 9:
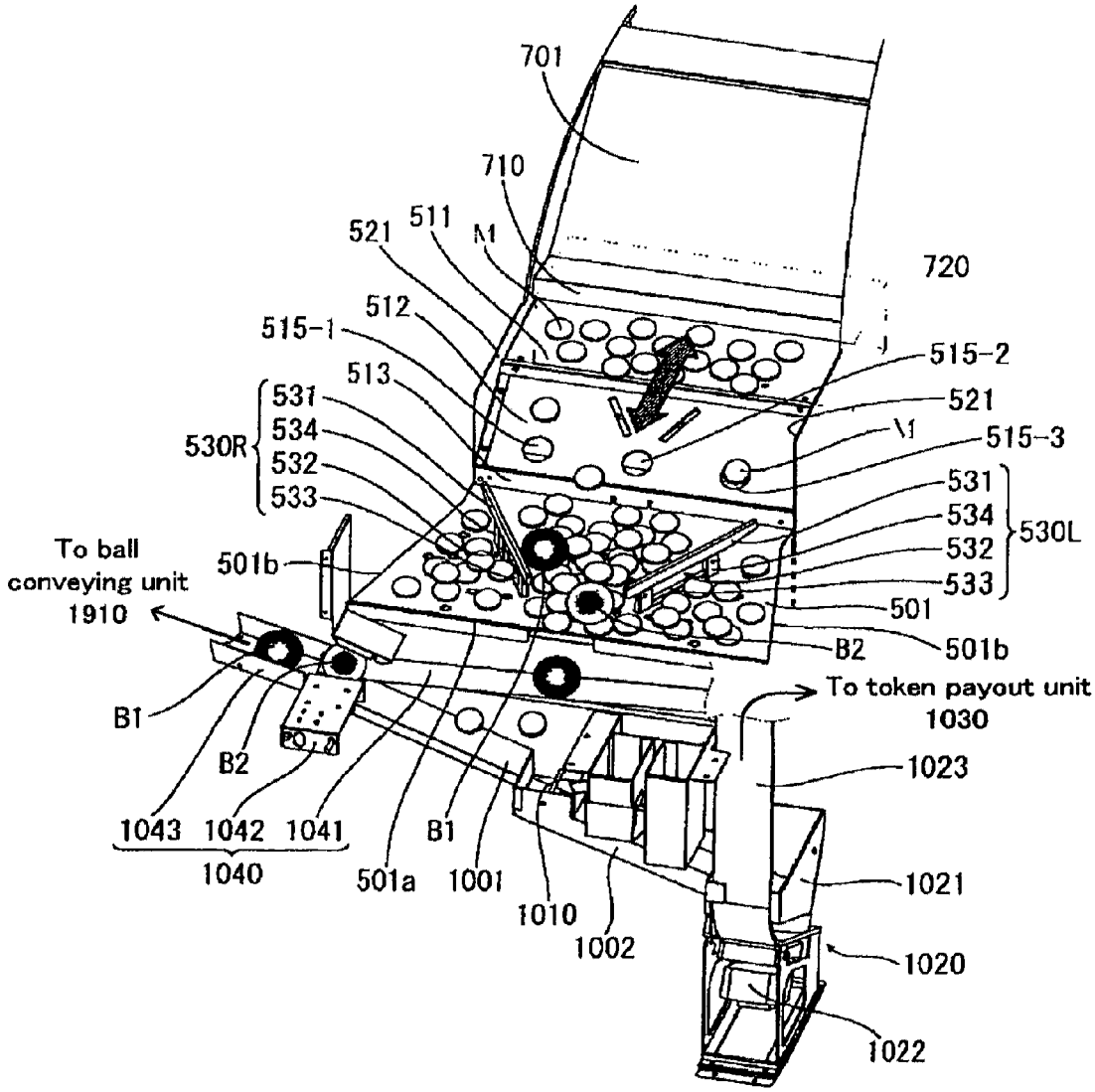
FIG. 9 is a partial perspective view in which a constitution of a play field of the station unit and a peripheral part thereof is extracted.
Figure 10A:
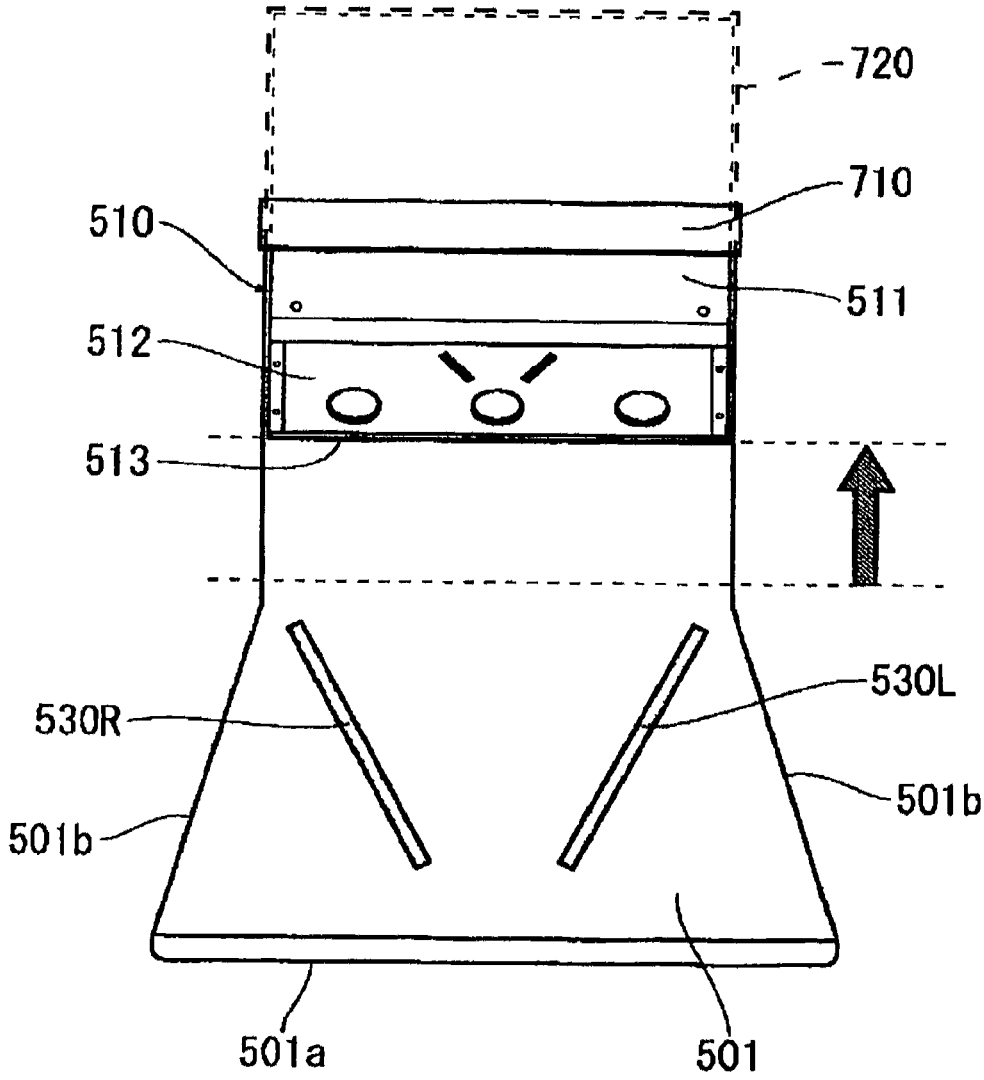
FIG. 10A is an explanatory view for explaining a reciprocating movement of a pusher unit in the play field.
Figure 10B:
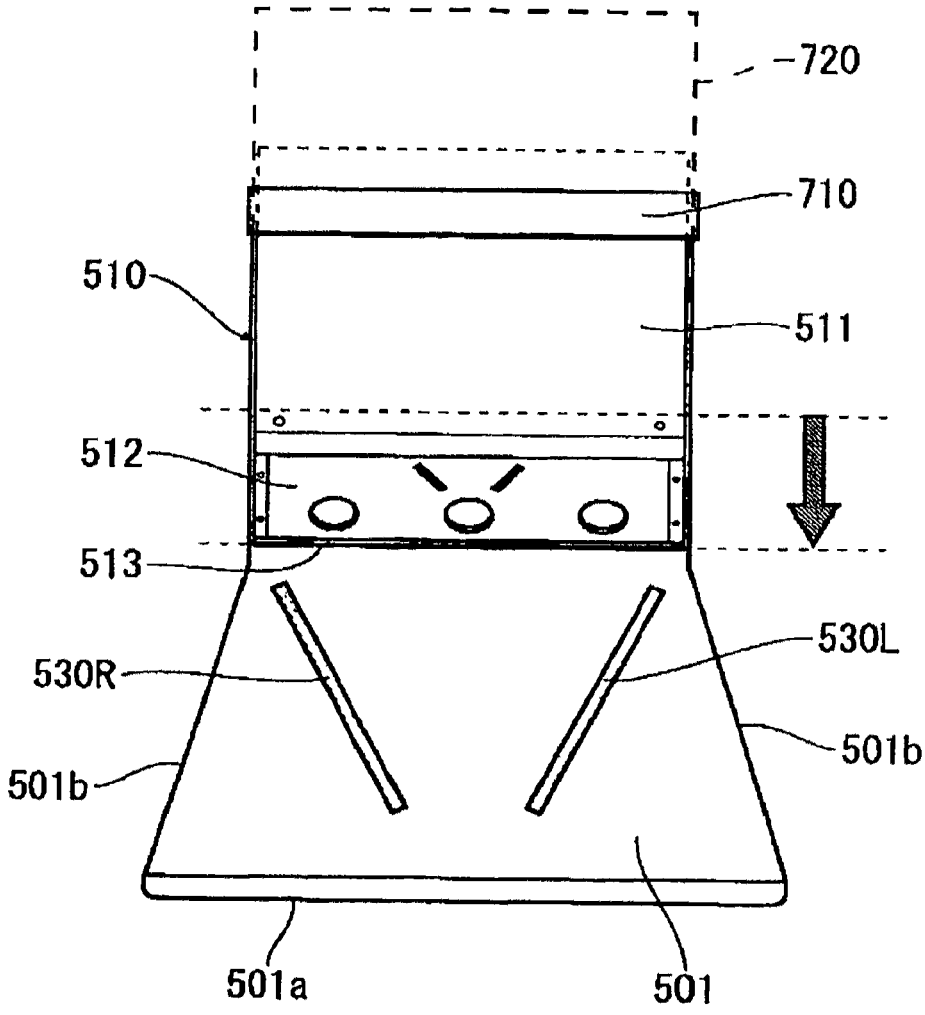
FIG. 10B is an explanatory view for explaining the reciprocating movement of the pusher unit in the play field.
Figure 11:
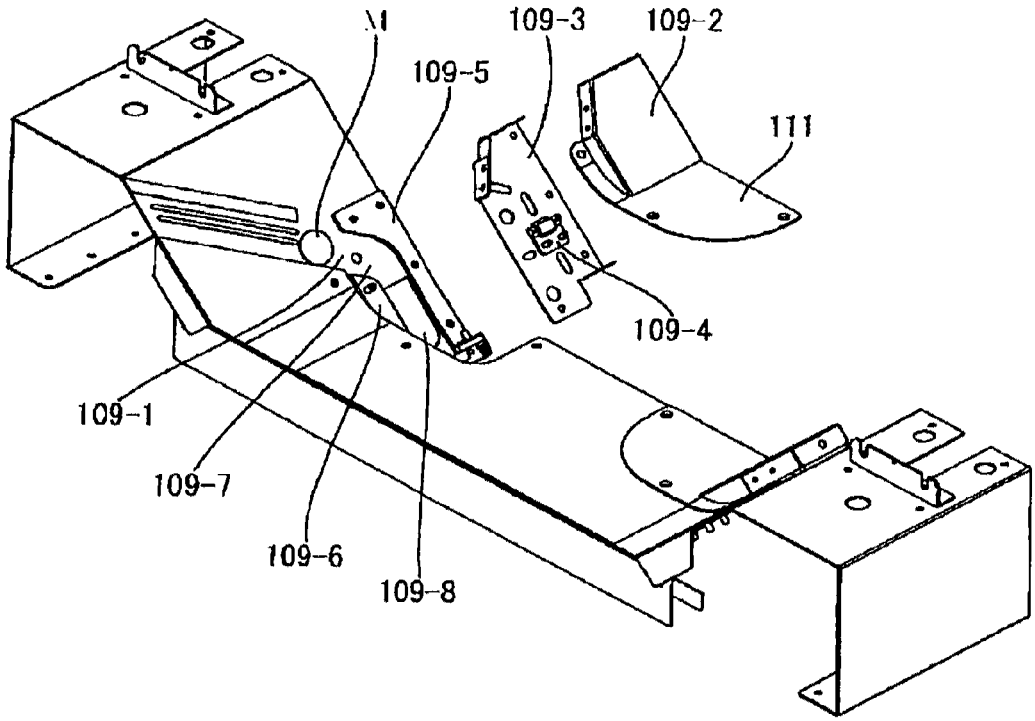
FIG. 11 is a front view of a token inserting mechanism.

(Constitution of play field) FIG. 9 is a partial perspective view in which a constitution of the play field 500 and the peripheral part thereof is extracted. FIG. 10A and FIG. 10B are explanatory view for explaining a reciprocating movement of the pusher unit 510 in the play field 500. As described above, the play field 500 is composed of the main table 501 that is the token placed base, and the pusher unit 510 that is the token pushing-out member placed on the main table 501 so as to slide. The pusher unit 510 moves in a sliding manner back and forth on the main table 501 so as to enter into and leave from the accommodating unit 720 arranged below a display 701 of the display unit 700. In addition, FIG. 10A is an upper view taken when the pusher unit 510 retracts into the accommodating unit 720 to the greatest extent, whereas FIG. 10B is an upper view taken when the pusher unit 510 projects from the accommodating unit 720 to the greatest extent.

As described above, the frame member 710 of the display unit 700 is in contact with the sub-table 511, which is an upper face of the pusher unit 510. Therefore, tokens M stored on the sub-table 511, which is an upper face of the pusher unit 510, are pushed on the sub-table 511 by the frame member 710 toward the sloping table 512 when the pusher unit 510 moves to a direction at which it retracts into the accommodating unit 720 (refer to FIG. 10B→FIG. 10A), and thereby the tokens M on the sub-table 511 flow in a direction toward the sloping table 512 as a whole. As a result, part of the tokens M on the sub-table 511 in the vicinity of the sloping table 512 is dropped to the sloping table 512. In addition, of the thus dropped tokens M, part of the tokens M enters into any one of chuckers 515-1, 515-2 and 515-3 arranged on the sloping table 512, and the remaining of them are dropped on the main table 501. Further, a drop prevention wall 521 is provided on both sides covering a range at which the pusher unit 510 slides, thereby preventing the tokens M from dropping from the sides of the sub-table 511.

Further, the pusher unit 510 is placed on the main table 501 without any clearance. In addition, "without any clearance" referred to here means that there is no clearance, which is greater than the width of the token M. Therefore, the tokens M stored on the main table 501 are pushed by the pushing wall 513, which is the front face of the pusher unit 510, toward the front end 501*a* on the main table 501 when the pusher unit 510 moves to a direction at which it leaves from the accommodating unit 720 (refer to FIG. 10A→FIG. 10B) and the tokens M on the main table 501 flow in a direction toward the front end 501*a* as a whole. As a result, part of the tokens M on the main table 501 in the vicinity of the front end 501*a* is dropped into the token dropping groove from the front end 501*a*. Also, part of the tokens M on the main table 501 in the vicinity of the end (side end 501*b*) on both sides of the main table 501 may be dropped from the side end 501*b* by the flow of the tokens M. In addition, the tokens M dropped from the side end 501*b* are stored at a predetermined storing unit (a hopper is also acceptable) inside the station unit ST.

Still further, as shown in FIG. 9, the tokens M dropped from the front end 501*a* are received on a token receiver 1001 arranged below the front end 501*a*, that is, inside the token dropping groove. The token receiver 1001 is connected to a token transfer channel 1002 for transferring the tokens M to the lift-up hopper 1020 in a token payout mechanism. Further, the token receiver 1001 is inclined toward a connecting part with the token transfer channel 1002. Therefore, the tokens M received on the token receiver 1001 flow into the token transfer channel 1002. The token transfer channel 1002 is also inclined toward a storing unit 1021 in the lift-up hopper 1020 of the token payout mechanism. Therefore, the tokens M that have flown into the token transfer channel 1002 are continuously led to the token payout mechanism. In addition, an assortment bar 1010 to be described later for stopping the ball B1 or B2 is arranged at the connecting part between the token receiver 1001 and the token transfer channel 1002, and by which the ball B1 or B2 does not enter into the token payout mechanism.

The token payout mechanism is provided with a token counter (not illustrated) for counting the number of tokens M, in addition to the above-described lift-up hopper 1020 and the token payout unit 1030. The token counter is arranged, for example, at an inlet of the storing unit 1021 in the lift-up hopper 1020, and counts the number of tokens M inserted from the token transfer channel 1002 to the storing unit 1021. The control unit 600 shown in FIG. 5 is notified of the number of the tokens M counted by the token counter. The control unit 600 drives the lift-up hopper 1020 on the basis of the thus notified number of the tokens, thereby the corresponding number of the tokens M is paid out from the token payout unit 1030 to the storing portion 101 in the token inserting mechanism 100. The lift-up hopper 1020 includes a hopper driving unit 1022 and a lift-up unit 1023. The hopper driving unit 1022 is driven on the basis of control from the control unit 600, thereby the tokens M are paid from the token payout unit 1030 arranged at the end of the lift-up unit 1023. In addition, the token payout mechanism, which is a payout unit including the token receiver 1001, the token transfer channel 1002, the lift-up hopper 1020, the token payout unit 1030 and the token counter, function as payout means for paying out to a player the tokens M dropped from the front end 501*a* of the main table 501 to the token dropping groove.

Further, the balls B1 and B2 supplied from the ball carrier 1520 of the satellite drawing device 1000 are also present on the main table 501. These balls B1 and B2 move on the main table 501 in association with a flow of the tokens M by the reciprocating movement of the pusher unit 510 and thereafter drop from the front end 501*a* into the token dropping groove. As described above, the ball transfer channel 1040 is arranged below the front end 501*a*, that is, inside the token dropping groove. The ball transfer channel 1040 includes the ball receiving unit 1041 which receives only the fallen ball B1 or B2 and allows the tokens M to pass, a ball halting unit 1042 which retains the ball received at the ball receiving unit 1041 until a predetermined condition is satisfied, and the ball discharge port 1043. Therefore, the ball B1 or B2 which has been received at the ball receiving unit 1041 is halted by the ball halting unit 1042 until a predetermined timing and thereafter discharged from the ball discharge port 1043. Thereby, the ball B1 or B2 is set to the ball conveying unit 1910 (refer to FIG. 4) kept on standby at the ball discharge port 1043. In addition, the position of the station unit ST shown in FIG. 4 and the station unit ST shown in FIG. 5 or FIG. 9 are reversed in the lateral direction for the convenience of explanation but similar in constitution.

(Constitution of token inserting mechanism) The token inserting mechanism 100 includes a horizontal region 21, a first sloping region 22 and a second sloping region 23 located on both sides of the horizontal region 21, a first side structure 117 located outside the first sloping region 22, and a second side structure 118 located outside the second sloping region 23. The token inserting mechanism 100 also includes a storing portion 101 for storing a plurality of tokens. The storing portion 101 constitutes the horizontal region 21 of the token inserting mechanism 100.

The token inserting mechanism 100 further includes a first sloping wall extending while sloping upward continuously from a first boundary region 102 in contact with a first side unit of the storing unit 101. The first sloping wall forms the first sloping region 22. The first sloping wall is constituted with a first sloping-wall-lower-region 104 and a first sloping-wall-upper-region 106. The first boundary region 102 is constituted with curved surfaces.

The token inserting mechanism 100 further includes a second sloping wall extending while sloping upward continuously from a second boundary region 103 in contact with a second side unit of the storing portion 101 located on the side opposite to the first side unit. The second sloping wall forms the second sloping region 23. The second sloping wall is constituted with a second sloping-wall-lower-region 105 and a second sloping-wall-upper-region 107. The second boundary region 103 is constituted with curved surfaces.

Figure 12:
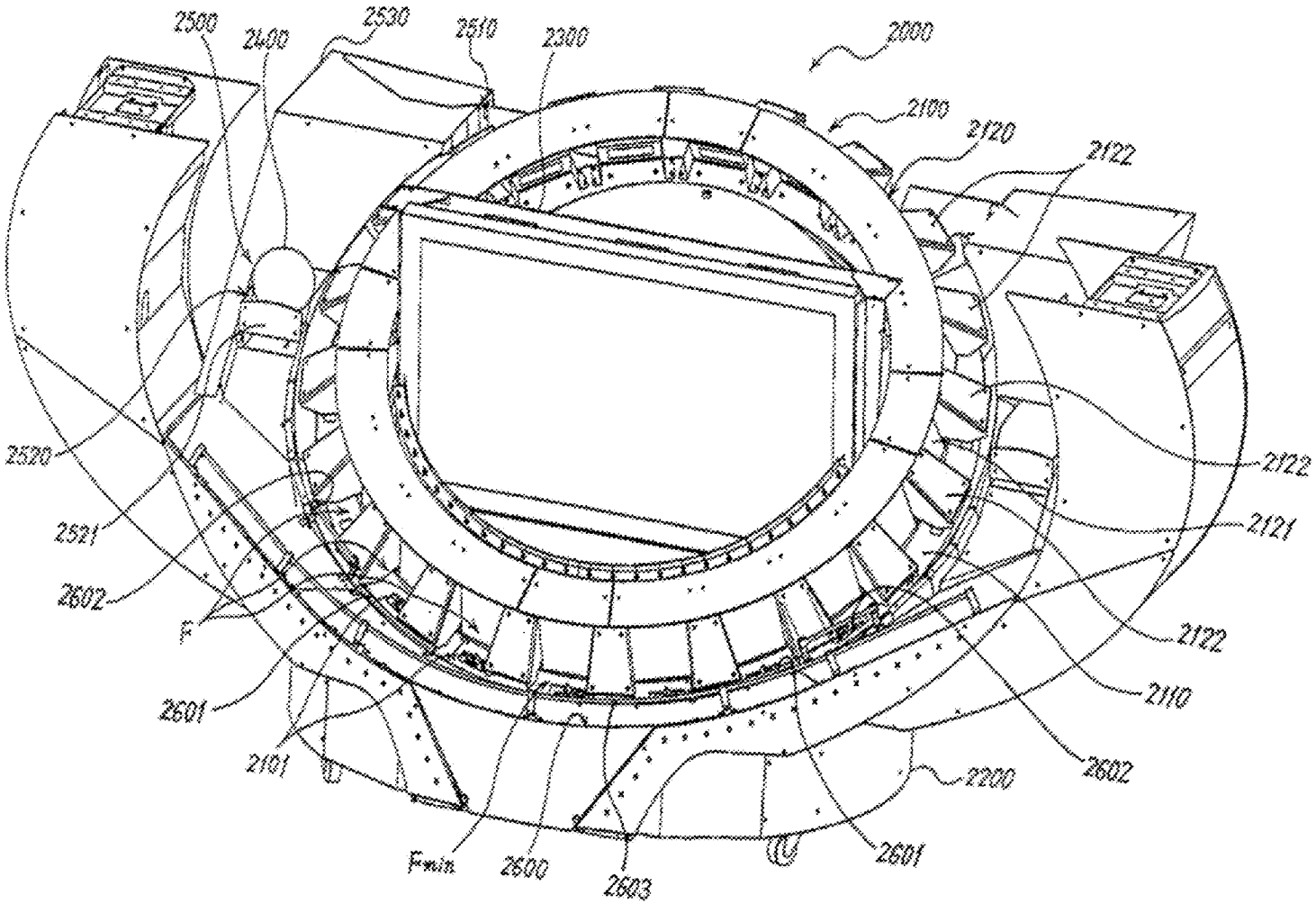
FIG. 12 is a perspective view showing a constitution of the center drawing device.
Figure 13:
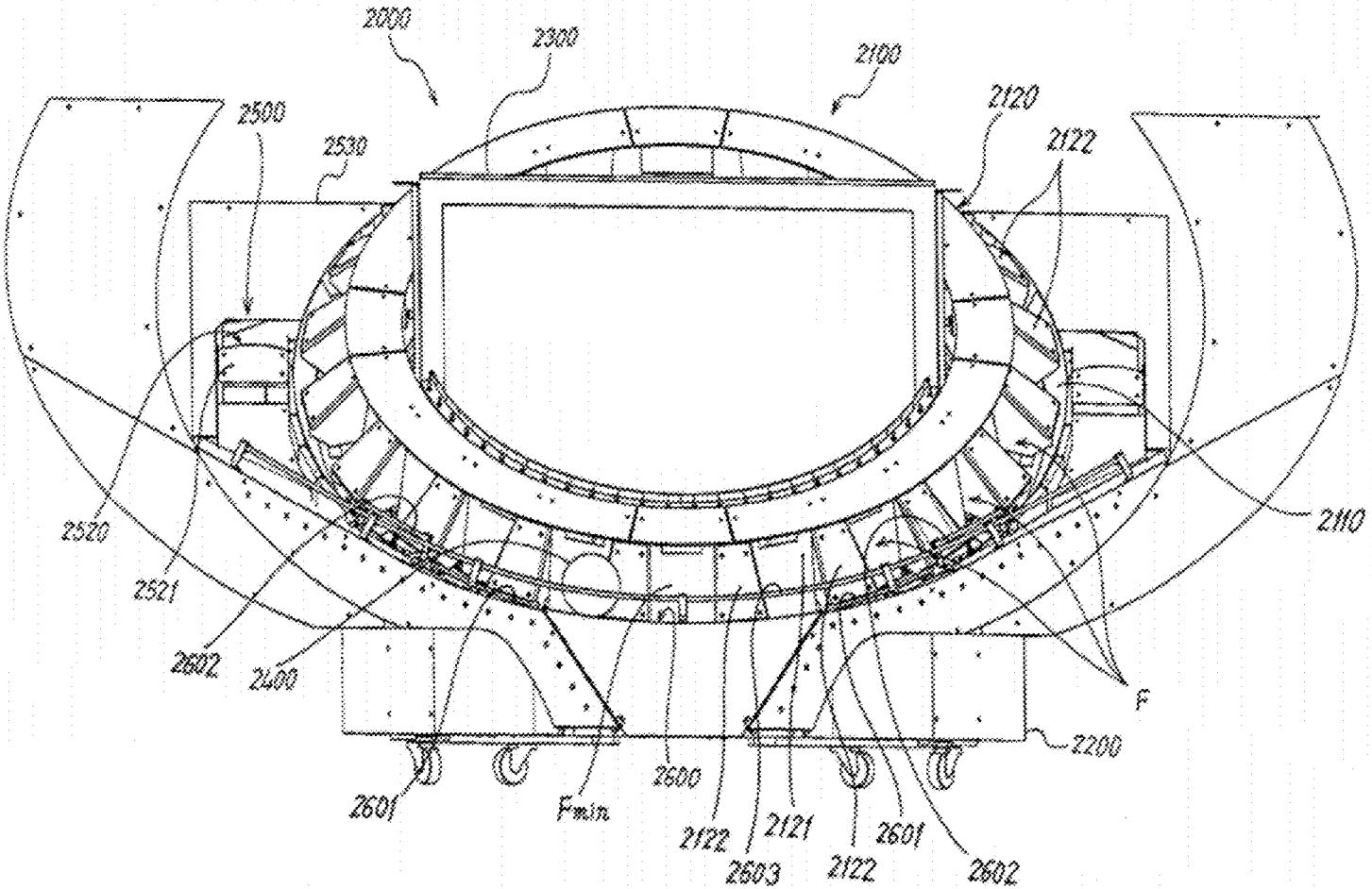
FIG. 13 is a front view showing the constitution of the center drawing device.
Figure 14:
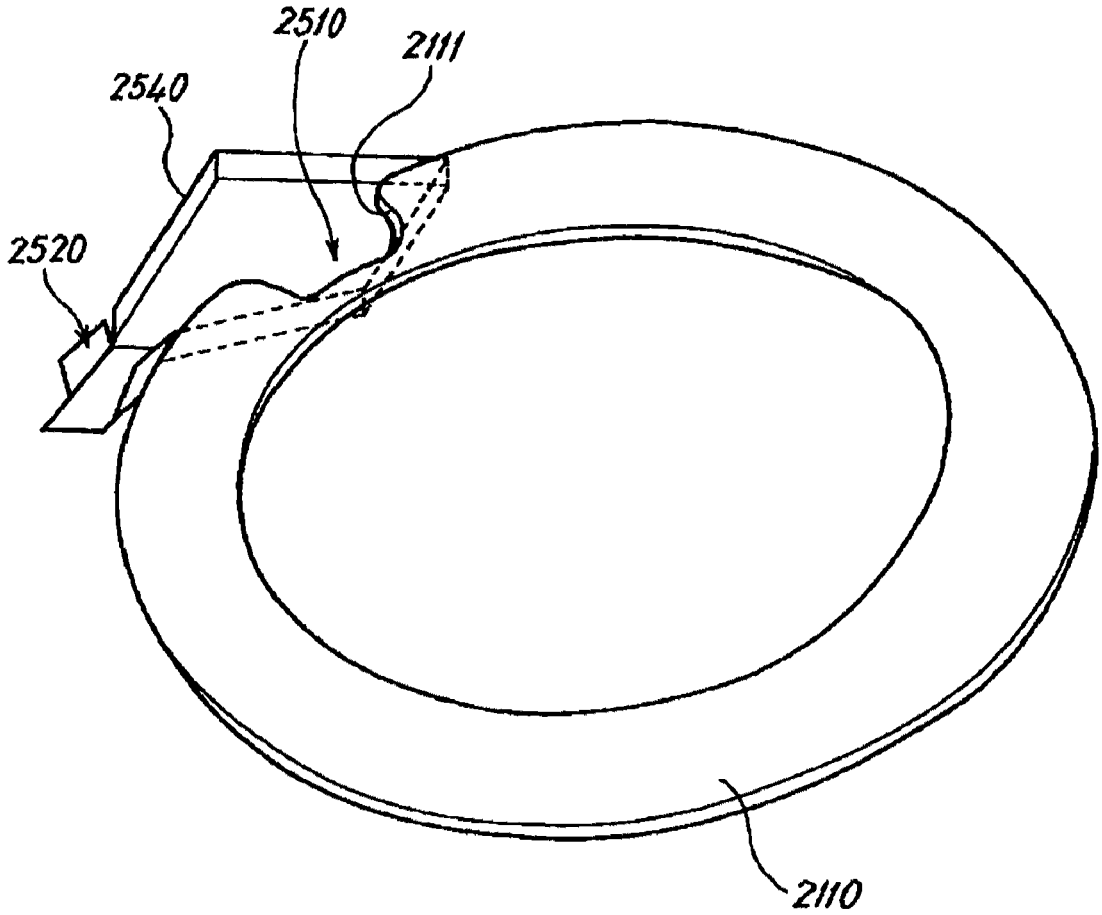
FIG. 14 is an explanatory view showing part of a rotational transfer device in the center drawing device.

(Constitution of center drawing device) Next, a description is given of a constitution of the center drawing device 2000. FIG. 12 is a perspective view showing the constitution of the center drawing device 2000. FIG. 13 is a front elevational view showing a constitution of the center drawing device 2000. The center drawing device 2000 is mainly composed of a large disk-shaped rotational transfer device 2100, a device supporting base 2200 for supporting the rotational transfer device 2100 from vertically below, a display device 2300, a large-ball-inserting-mechanism 2500 for inserting a large drawing ball 2400, and a transfer slope 2600 for transferring the large drawing ball 2400 inserted from the large-ball-inserting-mechanism 2500 to the rotational transfer device 2100.

The rotational transfer device 2100 is rotationally driven counterclockwise in the drawings by a driving device (not illustrated) mounted on the device supporting base 2200. The rotational transfer device 2100 constantly rotates by this driving device at a fixed cycle after the power supply of the pusher game machine 1 is turned on. A plurality of retention spaces F having an inner space for accommodating only one large drawing ball 2400 are formed in the outer circumferential direction in the outer circumferential region of the rotational transfer device 2100. In the present embodiment, twenty retention spaces F is arranged at equal intervals in the outer circumferential region of the rotational transfer device 2100. Each of the retention spaces F rotationally moves along the outer circumference of the rotational transfer device 2100 due to the rotation of the rotational transfer device 2100. The rotational transfer device 2100 of the present embodiment is inclined both in a perpendicular direction and in a horizontal direction. Thus, each of the retention spaces F rotationally moves along a virtual flat surface inclined both in a perpendicular direction and in a horizontal direction.

The large-ball-inserting-mechanism 2500 is arranged on the left side of the rotational transfer device 2100 shown in the drawings. The large-ball-inserting-mechanism 2500 is mainly composed of a ball collecting port 2510 for receiving the large drawing ball 2400, a ball retaining part 2520 for retaining the large drawing ball 2400 received from the ball collecting port 2510, and a case 2530. The large drawing ball 2400 that has entered into the ball collecting port 2510 is transferred through the interior of the case 2530 to the ball retaining part 2520 due to its own weight and stopped by a ball stopper 2521 of the ball retaining part 2520. The ball stopper 2521 is moved between a ball retaining position for stopping the large drawing ball 2400 and a ball releasing position for releasing the large drawing ball 2400 according to control by the control unit (not illustrated) of the center drawing device 2000. In addition, FIG. 12 shows a state that the ball stopper 2521 is positioned at the ball retaining position and the large drawing ball 2400 is retained at the ball retaining part 2520. In the present embodiment, an introduction mechanism is mainly composed of the ball retaining part 2520 and the ball stopper 2521.

Figure 17:
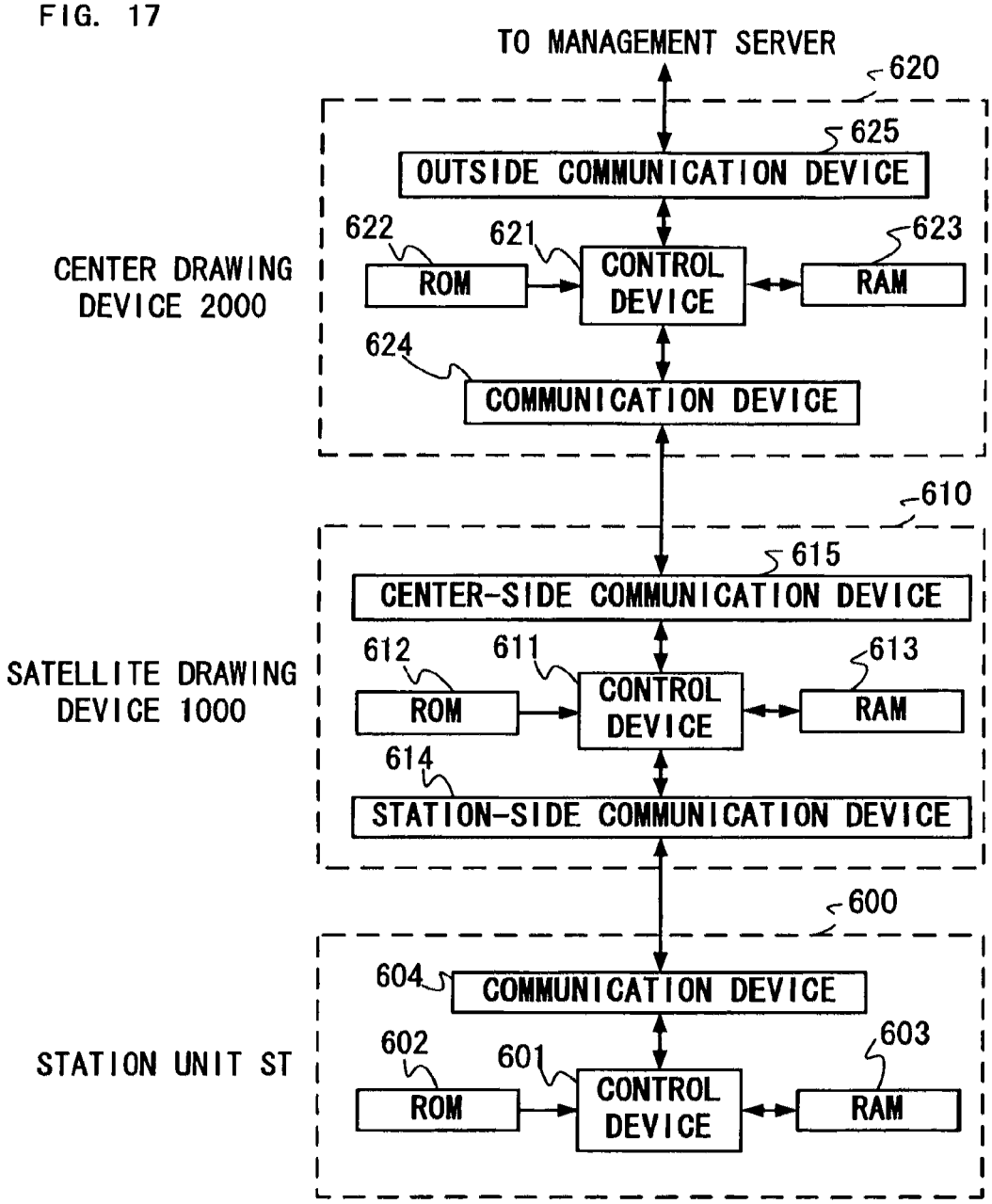
FIG. 17 is a block diagram showing a major constitution of a game control system in the pusher game machine.

When the ball stopper 2521 moves from the ball retaining position to the ball releasing position to release a retaining state of the ball retaining part 2520, the large drawing ball 2400 retained at the ball retaining part 2520 rolls into the transfer slope 2600 as a guiding mechanism by its own weight. Thereby, as shown in FIG. 17, the large drawing ball 2400 rolls on the transfer slope 2600 by its own weight, moving like a pendulum around a lowest point on a slope surface (upper face) which is an inclined face of the transfer slope 2600. The transfer slope 2600 is provided with the slope surface (a inclined face) that a lowest point thereof is a point at which the large drawing ball 2400 is placed when the large drawing ball 2400 is present at a position adjacent to a lowest point of a retention-space-moving-channel on which each of the retention spaces F of the rotational transfer device 2100 rotationally moves. Thereby, the large drawing ball 2400 is let into a drawing slot of any one of the retention spaces F by the slope surface. The slope surface is formed in such a manner that the large drawing ball 2400 can move adjacently with respect to one or two or more retention spaces F including a retention space $F_{min}$ positioned at a lowest point of the retention-space-moving-channel. In the present embodiment, the slope surface is formed so that the large drawing ball 2400 can move adjacently with respect to the total three retention spaces F including two retention spaces F adjacent thereto when the retention space $F_{min}$ is positioned exactly at the lowest point of the retention-space-moving-channel.

More specifically, on a retention-space-moving-channel side of the transfer slope 2600, entry preventive barriers 2601 and 2602 are arranged on both sides of a space that is an entry space covering three retention spaces positioned at the center of the lowest point. These entry preventive barriers 2601 and 2602 prevent the large drawing ball 2400 on the slope surface from moving to the retention-space-moving-channel of the rotational transfer device 2100 beyond the entry preventive barriers 2601 and 2602. Further, part of the slope surface at least facing the entry space is constituted so as to incline toward the retention-space-moving-channel of the rotational transfer device 2100. Therefore, the large drawing ball 2400 inserted from the large-ball-inserting-mechanism 2500 moves on the transfer slope 2600 like a pendulum around the lowest point and a moving speed thereof gradually reduces, finally the large drawing ball 2400 moves toward the retention-space-moving-channel side of the slope surface by the inclination and its own weight, and thereafter moves via the entry space to the retention-space-moving-channel of the rotational transfer device 2100. In this point, the large drawing ball 2400 enters into a drawing slot of the retention space F present at a position facing the entry space among the retention spaces F moving rotationally by the rotation of the rotational transfer device 2100.

In the present embodiment, the transfer slope 2600 is constituted so that the lowest point thereof inclines the most toward the rotational transfer device 2100 and the large drawing ball 2400 can enter into the retention space F of the rotational transfer device 2100 more easily as it comes closer to the lowest point of the transfer slope 2600. The transfer slope 2600 is also provided with a guide barrier 2603 all over the end part at the opposite side of the transfer slope 2600 so that the large drawing ball on the transfer slope 2600 does not fall on the side (front side in the drawings) opposite to the retention-space-moving-channel.

As shown in FIG. 12, a ball sensor 2101 for detecting the fact that the large drawing ball 2400 has entered into the corresponding retention space F is arranged inside each of the retention spaces F of the rotational transfer device 2100. Each of the ball sensors 2101 is connected to the control unit to be described later of the center drawing device 2000 and the detection signal is to be sent to the control unit. Thereby, the control unit of the center drawing device 2000 is able to grasp which of the retention spaces F the large drawing ball 2400 has entered.

Further, in the present embodiment, there is a movement mechanism for moving the large drawing ball 2400 in the retention space F to the ball collecting port 2510 only by its own weight when the retention space F retaining the large drawing ball 2400 rotationally moves to a collecting space and opposes the ball collecting port 2510.

Figure 15:
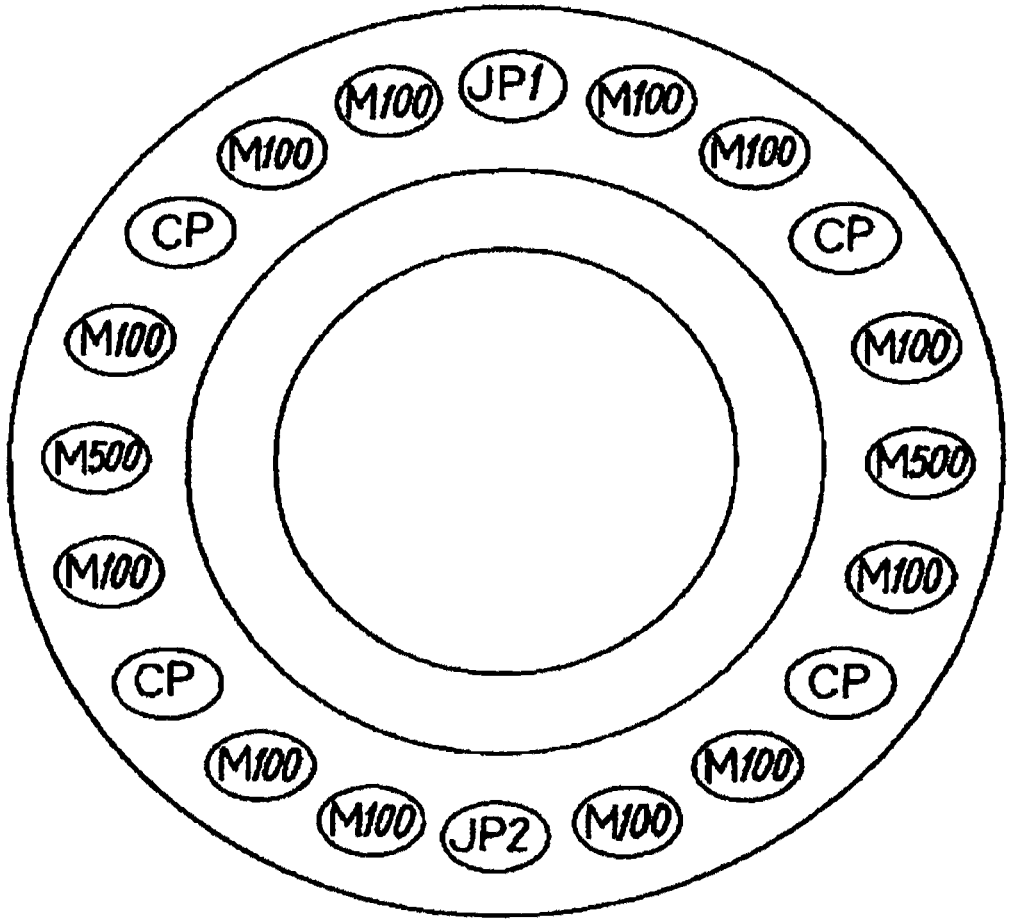
FIG. 15 is an explanatory view showing schematically a corresponding relationship between prizes and twenty retention spaces composed of the center drawing device in the pusher game machine.

FIG. 15 is an explanatory view showing schematically a corresponding relationship between prizes and twenty retention spaces F. In the present embodiment, a prize is allocated to each of the retention spaces F. In the present embodiment, the prizes include token supply prizes M100 and M500, a chance pocket prize CP and jackpot prizes JP1 and JP2 being specified prizes. In the center drawing device 2000, a physical drawing (jackpot game) about which of the retention spaces F the large drawing ball 2400 enters into is carried out.

The token supply prizes M100 and M500 supply respectively 100 pieces and 500 pieces of tokens M to the play field 500 of the station unit ST in which a start condition of the jackpot game are satisfied. In addition, the number of tokens supplied on winning the token supply prizes M100, M500 is preferably smaller than an initial value of the jackpot value.

Further, the chance pocket prize CP is an prize that when the prize is awarded, the above-described predetermined event condition is satisfied, thereby during a subsequent predetermined event period, in the satellite unit SA to which the station unit ST satisfying the start condition of the jackpot game belongs, a winning bingo number drawn by the physical drawing carried out at the satellite drawing device 1000 at any one of the four station units ST belonging thereto is handled as a winning bingo number also in the other three station units ST. Still further, the chance pocket prize CP is handled as a payout-amount increasing prize. That is, the chance pocket prize CP is a prize that a jackpot value (payout amount) of the second jackpot prize to be described later is cumulatively increased only by a predetermined amount (for example, 100 pieces). In addition, when the chance pocket prize CP is awarded, 100 pieces of tokens M are supplied to the play field 500 of the station unit ST that satisfies the start conditions of the jackpot game. At this point, the chance pocket prize CP is also a token supply prize.

The jackpot prizes JP1 and JP2 are available as two types in the present embodiment. The first jackpot prize JP1 is an prize that the amount of tokens M corresponding to the first jackpot value (payout amount) are supplied (paid out) to the play field 500 of the station unit ST which has satisfied the start condition of the jackpot game. The first value data (payout amount data) indicating the first jackpot value is stored at a RAM (storage unit) of the control unit in the center drawing device 2000. A count value of the first value data, that is, the first jackpot value, is obtained by cumulatively adding the number of pieces (for example, 0.03 pieces) corresponding to part of the number of inserted tokens every time the tokens are inserted at all the station units ST to a predetermined initial value (for example, 500 pieces). The second jackpot prize JP2 is an prize that the amount of tokens M corresponding to the second jackpot value (payout amount) are supplied (paid out) to the play field 500 of the station unit ST which has satisfied the start condition of the jackpot game. The first value data (payout amount data) indicating the second jackpot value is also stored at the RAM (storage unit) of the control unit of the center drawing device 2000. A count value of the second value data, that is, the first jackpot value, is obtained by cumulatively adding a predetermined amount (for example, 100 pieces) every time the chance pocket prize CP is awarded in the preceding jackpot game to a predetermined initial value (for example, 500 pieces).

In the present embodiment, the control unit (not illustrated), which is a payout-amount increasing unit, of the center drawing device 2000 handling the above-described addition processing functions as payout-amount increasing means. Further, in the present embodiment, the number of tokens supplied to the play field 500 when these jackpot prize JP1 or JP2 is awarded, that is, the jackpot value, is set to be largest in number among the number of tokens which can be supplied at one time to the play field 500 in the present pusher game machine 1. Therefore, a player who plays at the present pusher game machine 1 usually plays aiming at obtaining these jackpot prizes.

Figure 16:
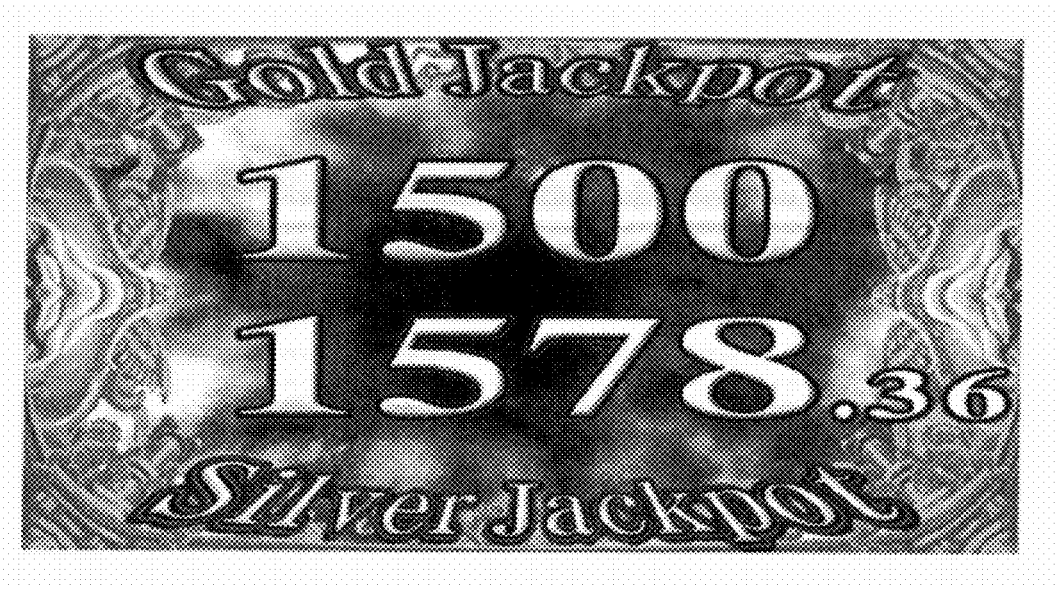
FIG. 16 is an explanatory view showing one example of a screen displayed on a display device of the center drawing device.

Further, as shown in FIG. 16, the display device 2300 of the center drawing device 2000 displays a screen indicating the present jackpot value, that is, the number of tokens which are to be supplied to the play field 500 when the jackpot prize is awarded, during a period in which no jackpot game is carried out. On the other hand, during a period in which a jackpot game is carried out, a screen for performing the jackpot game is displayed.

On starting a jackpot game, the device supporting base 2200 itself rotates around a rotating shaft parallel to a perpendicular direction by a driving device (not illustrated), thereby the center drawing device 2000 moves to face the front of the satellite unit SA belonging to the station unit ST which has satisfied the start condition of the jackpot game. Thereafter, the jackpot game is allowed to progress. The jackpot game will be explained in details later.

(Constitution of game control system) FIG. 17 is a block diagram showing a major constitution of the game control system of the present pusher game machine 1. In addition, in the block diagram, a constitution of a driving control system or the like for driving each part according to the progression of the game is omitted for the convenience of explanation. The game control system of the present embodiment is mainly composed of the control unit 600 of the station unit ST, a control unit 610 of the satellite drawing device 1000 and a control unit 620 of the center drawing device 2000. The control unit 600 of the station unit ST is mainly in charge of a comprehensive control of progression of the above-described slot game and bingo game. The control unit 610 of the satellite drawing device 1000 is mainly in charge of controlling the physical drawing of the above-described bingo game and controlling the transfer of the balls B1 and B2. The control unit 620 of the center drawing device 2000 is mainly in charge of controlling the above-described jackpot game.

The control unit 600 of the station unit ST is mainly composed of a control device 601, a ROM 602, a RAM 603 and a communication device 604. The control device 601 executes various types of programs stored at the ROM 602, and thereby carries out various types of control. The ROM 602 stores programs and others for carrying out various types of control to be carried out at the control unit 600 of the station unit ST. The RAM 603 temporarily stores various types of data or information. The communication device 604 carries out data communications with the control unit 610 of the satellite drawing device 1000.

The control unit 610 of the satellite drawing device 1000 is mainly composed of a control device 611, a ROM 612, a RAM 613, a station-side communication device 614 and a center-side communication device 615. The control device 611 executes various types of programs stored at the ROM 612, and thereby carries out types of control. The ROM 612 stores programs and others for carrying out various types of control to be carried out at the control unit 610 of the satellite drawing device 1000. The RAM 613 temporarily stores various types of data or information. The station-side communication device 614 carries out data communications with the control unit 600 of each of the station unit ST belonging to this satellite unit SA. The center-side communication device 615 carries out data communications with the control unit 620 of the center drawing device 2000.

The control unit 620 of the center drawing device 2000 is mainly composed of a control device 621, a ROM 622, a RAM 623, a communication device 624 and an outside communication device 625. The control device 621 executes various types of programs stored at the ROM 622, and thereby carries out types of control. The ROM 622 stores programs and others for carrying out various types of control to be carried out at the control unit 620 of the center drawing device 2000. The RAM 623 temporarily stores various types of data or information. The communication device 624 carries out data communications with the control unit 610 of each of the satellite unit SA. The outside communication device 625 carries out data communications with outside devices such as the management server 4000 etc. via the WAN. In addition, the center drawing device 2000 includes, not illustrated, performance units for carrying out various types of performance, such as speakers, illumination devices or the like. The various types of performance is carried out by controlling these performance units by the control device 621

The above-described constitution has been explained for a case where the control unit 600 of the station unit ST, the control unit 610 of the satellite drawing device 1000 and the control unit 620 of the center drawing device 2000 are connected in series. However, these control units 600, 610, 620 may be connected parallel to each other (star type or bus type).

Figure 18:
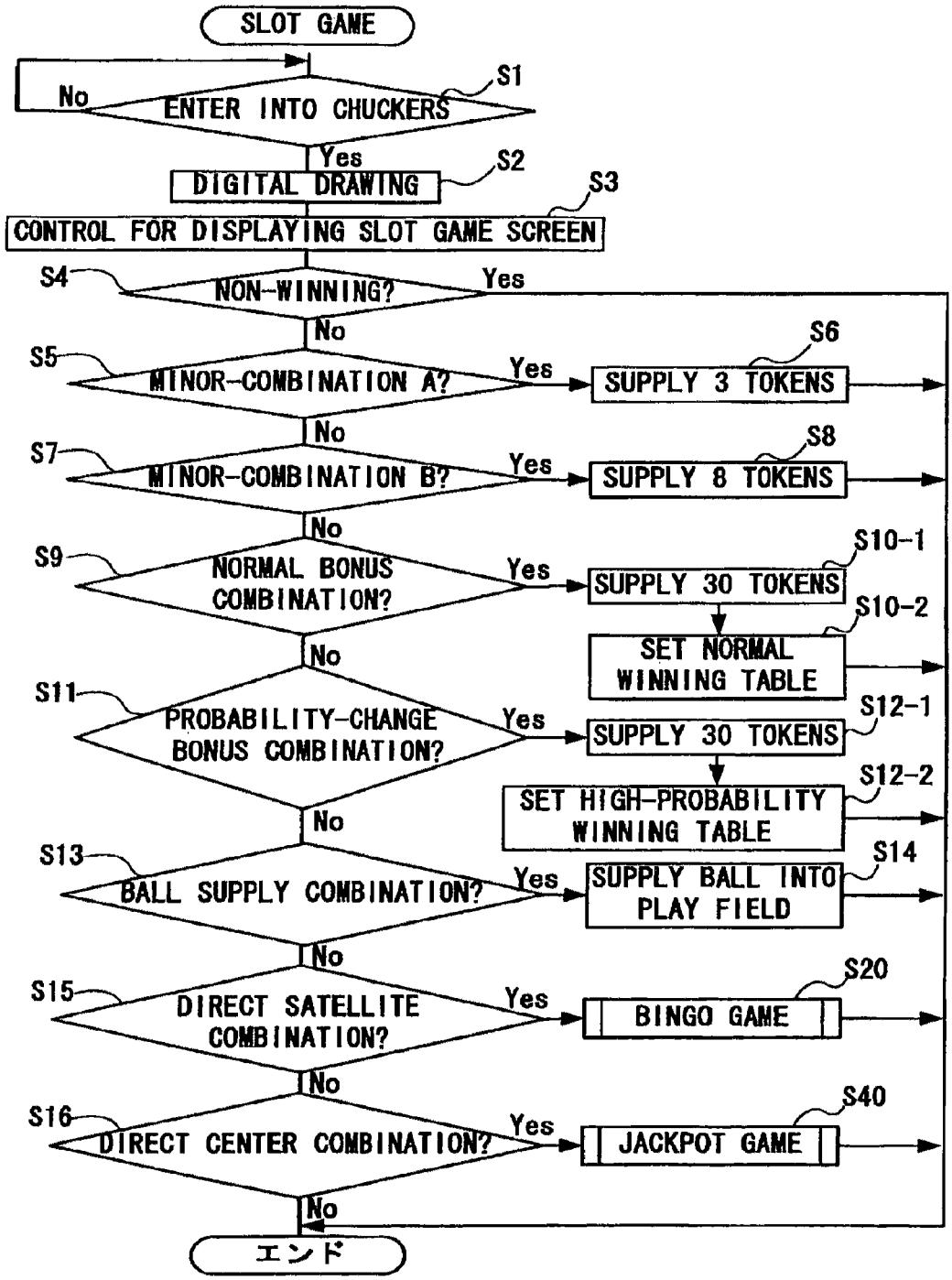
FIG. 18 is a flow chart showing a flow of a slot game carried out in the pusher game machine.

(Flow of slot game) Next, a description is given of a flow of the slot game which progresses in the pusher game machine 1 in the present embodiment. FIG. 18 is a flow chart showing the flow of the slot game in the present embodiment. When a player inserts tokens M on the storing portion 101 into the first token inserting port 108-1 or the second token inserting port 109-1 in a manner as described above, tokens M are inserted to the sub-table 511 inside the play field. Then, when, of the tokens M which have been dropped from the sub-table 511, part of them enters into any one of chuckers 515-1, 515-2 and 515-3 arranged on the sloping table 512 and is detected by a token detecting unit (not illustrated), its detection signal is sent to the control device 601 of the control unit 600 of the station unit ST, and thereby the control device 601 comprehends that the token M has entered into any one of the chuckers 515-1, 515-2 and 515-3 (S1). Thereby, the control device 601 determines that the start condition of the slot game is satisfied and executes a drawing program stored at the ROM 602. Thereby, the control device 601 carries out the digital drawing for deciding a winning in which any one of the above specific-combinations is awarded or a non-winning by referring to a predetermined winning table and using a generated random number (S2). Further, the control device 601 carries out a display control of rotating the three dice-shaped slots DS on the slot game screen shown in FIG. 6, which is displayed on the display unit 700, and thereafter carries out a display control of halting the rotation of the three dice-shaped slots DS so that where a winning combination is decided by the digital drawing, a pattern of symbols related to the winning combination is halted and displayed on the display unit 700 (S3).

Where the non-winning that is any one of the specific-combinations is not awarded by the above digital drawing (S4), the control device 601 finishes the slot game as it is. On the other hand, where the minor-combination A is awarded (S5), the control device 601 controls a token supply unit (not illustrated) to supply three tokens to the play field 500 (S6). The token supply unit may be commonly used with the above-described mechanism for inserting tokens M onto the sub-table 511 inside the play field when a player inserts tokens M on the storing portion 101, or it may be provided separately from the mechanism. Where the token supply unit is provided separately from the mechanism, it may be similar in constitution to the mechanism. In other words, such a constitution may be made that tokens M are lifted up to a supply end on a token discharge channel by using a lift-up hopper and supplied via the token discharge channel from a discharge end to the play field 500. Further, where the minor-combination B is awarded (S7), the control device 601 controls the token supply unit to supply eight tokens to the play field 500 (S8).

Further, where the normal bonus combination is awarded (S9), the control device 601 controls the token supply unit to supply thirty tokens to the play field 500 (S10-1). Further, the control device 601 changes a setting so that an normal winning table in which a winning probability is set lower is used, as a winning table to be used in subsequent digital drawings (S10-2). Further, where the probability-change bonus combination is awarded (S11), the control device 601 controls the token supply unit to supply thirty tokens to the play field 500 (S12-1). Further, the control device 601 changes a setting so that a high-probability winning table in which a winning probability is set higher is used, as a winning table to be used in subsequent digital drawings (S12-2).

Further, where the ball supply combination is awarded (S13), the control device 601 outputs the ball supply order for supplying the ball B1 to the control device 611 of the control unit 610 in the satellite drawing device 1000. Thereby, the ball B1 is delivered from the ball supply mechanism 1300 to the ball carrier 1520, and the ball B1 is delivered from the ball carrier 1520 to the ball inserting mechanism 1800 of the station unit ST at which the ball supply combination is awarded. The ball B1 that has been delivered to the ball inserting mechanism 1800 is retained temporarily by the stopper 1802 of the ball inserting slope 1801. Then, a player pushes the button 160, by which the control device 601 allows the ball B1 to be released from the stopper 1802 at a timing when the control device 601 receives its button operating signal, and the ball B1 rolls down on the ball inserting slope 1801 and is delivered to the ball-inserting-position-drawing-mechanism 1810. Then, a drawing for selecting a ball supply position on the play field 500 is carried out at a ball-inserting-position-drawing-mechanism 1810, and thereafter the ball B1 is supplied either to the back side or the front side on the main table 501 (S14). The ball-inserting-position-drawing-mechanism 1810 is constituted so that a ball receiving port through which the balls B1 and B2 are allowed to pass moves in a reciprocating manner between the front side and the back side around the lowest point of the ball inserting slope 1801. When the ball enters into the ball receiving port, this ball is supplied to the front side on the main table 501. When the ball does not enter into the ball receiving port, this ball is supplied to the back side on the main table 501. Where the ball is supplied to the front side on the main table 501, there is a shorter moving distance up to the token dropping groove as compared with a case where the ball is supplied to the back side on the main table 501, thereby the ball B1 falls more easily into the token dropping groove and the start condition of the bingo game can be satisfied more easily. As a result, a player is to play so as to push the button 160 at a timing when the ball B1 that has been retained at the stopper 1802 enters into the ball receiving port of the ball-inserting-position-drawing-mechanism 1810.

Still further, where the direct satellite combination is awarded (S15), the control device 601 outputs the ball supply order for supplying the ball B1 to the control device 611 of the control unit 610 in the satellite drawing device 1000. Thereby, the ball B1 is delivered from the ball supply mechanism 1300 to the ball carrier 1520. Thereafter, the ball carrier 1520 moves to a position opposed to the stage-ball-inserting-mechanism 1600, delivering the ball B1 to the catch pan 1610 of the stage-ball-inserting-mechanism 1600. Then, a player pushes the button 160, by which the control device 601 outputs the ball inserting order to the control device 611 of the control unit 610 in the satellite drawing device 1000 at a timing when the control device 601 receives its button operating signal. Thereby, the ball B1 is inserted via the ball inserting channel 1110 into the outer bingo stage 1100 to carry out the physical drawing. Where the direct satellite combination is awarded, the control device 601 decides that the start condition of the bingo game is satisfied and starts the bingo game to be described later (S20).

Furthermore, where the direct center combination is awarded (S16), the control device 601 outputs an order for starting a jackpot game via the control unit 610 of the satellite drawing device 1000 to the control device 621 of the control unit 620 in the center drawing device 2000. Thereby, the jackpot game is started in the center drawing device 2000 to be described later (S40).

Figure 19:
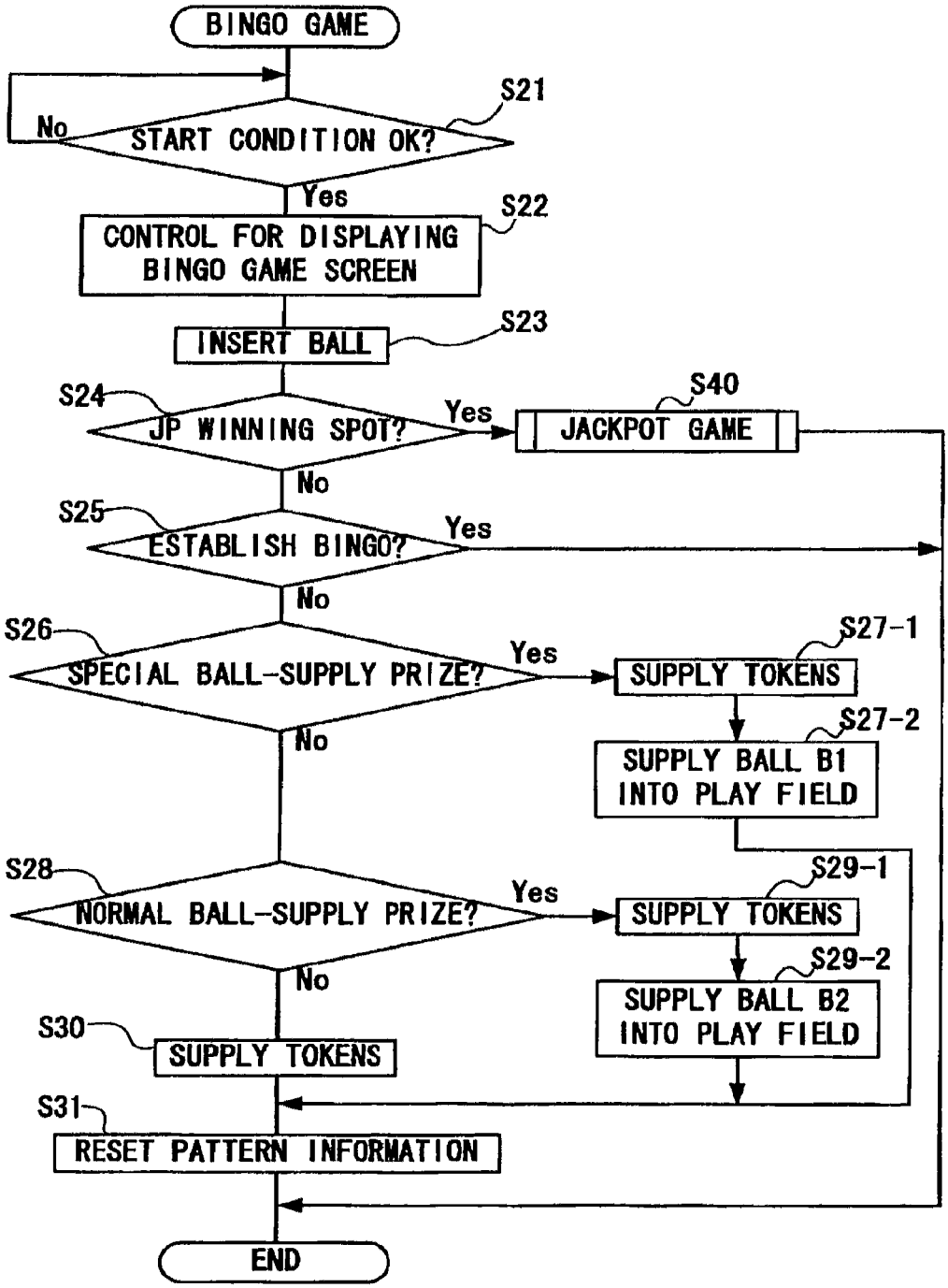
FIG. 19 is a flow chart showing a flow of a bingo game carried out in the pusher game machine.

(Flow of bingo game) Next, a description is given of a flow of the bingo game which progresses in the pusher game machine 1 in the present embodiment. FIG. 19 is a flow chart showing the flow of the bingo game in the present embodiment. In the bingo game of the present embodiment, when the start condition of the bingo game are satisfied, in which the ball B1 or B2 falls to the token dropping groove or the direct satellite combination is awarded in the above-described slot game (S21), the control device 601 of the control unit 600 in the station unit ST executes a bingo execution program stored at the ROM 602, thereby starting the bingo game. More specifically, the control device 601 first carries out a display control so as to switch the slot game screen, shown in FIG. 6, displayed on the display unit 700 to the bingo game screen shown in FIG. 7 (S22). At this time, the bingo card image BC on the bingo game screen is based on pattern information generated at an arbitrary timing in the past. The pattern information is generated at a timing, for example, when the power supply of the pusher game machine 1 is turned on, a reset button (not illustrated) is pushed, or BINGO is established in preceding bingo games. In the present embodiment, a description is given of a case where on establishment of BINGO in the bingo game, new pattern information is generated and then changed to the preceding pattern information.

Further, the control device 601 outputs a bingo starting order to the control device 611 of the control unit 610 in the satellite drawing device 1000 when the start condition of the bingo game are satisfied. Thereby, the control device 611 moves the ball carrier 1520 to a position opposite to an outlet of the ball-conveying-unit-running-slope 1901 in the ball conveying mechanism 1900 of the station unit ST that has received the order. Then, the control device 601 controls the ball conveying mechanism 1900, thereby transferring the ball B1 or B2, which has fallen to the token dropping groove, from the ball-conveying-unit-running-slope 1901 to the ball carrier 1520. Thereafter, as described above, the control device 611 of the control unit 610 in the satellite drawing device 1000 moves the ball carrier 1520 to a position opposite to the stage-ball-inserting-mechanism 1600, controlling the stage-ball-inserting-mechanism 1600 according to the type of the balls B1 and B2, thus inserting the ball B1 or B2 into the outer bingo stage 1100 or the inner bingo stage 1200 (S23).

When the ball B1 or B2 which has been inserted into the outer bingo stage 1100 or the inner bingo stage 1200 enters into any one of winning spots 1101 and 1201, the signal thereof is sent to the control device 611 of the control unit 610 in the satellite drawing device 1000. Thereby, the control device 611 is able to recognize which of the winning spots 1101 and 1201 the ball B1 or B2 has entered into. At this time, if the winning spot 1101 or 1201 into which the ball B1 or B2 has entered is a JP winning spot to which a right for starting the jackpot game in the center drawing device 2000 is allocated (Yes in S24), the control device 611 outputs the order for starting the jackpot game to the control device 621 of the control unit 620 in the center drawing device 2000. Thereby, the jackpot game is started in the center drawing device 2000 (S40).

On the other hand, if the winning spot 1101 or 1201 into which the ball B1 or B2 has entered is a winning spot to which the bingo number is allocated (No in S24), the control device 611 of the control unit 610 in the satellite drawing device 1000 outputs information indicating the thus allocated bingo number to the control device 601 of the control unit 600 in the station unit ST which satisfies the start condition of the bingo game. The control device 601 that has received the information stores the bingo number related to the information as a winning bingo number at a winning-bingo-number storing area of the RAM 603 as a storage unit functioning as storage means. In addition, winning bingo numbers since the generation of pattern information corresponding to the station unit ST are cumulatively stored at the winning-bingo-number storing area. Then, the control device 601, which is a decision unit, functions as decision means and carries out a bingo decision whether patterns of all the winning bingo numbers on a card pattern (a drawing object pattern) that is a pattern of bingo numbers of "1" to "9" on the bingo card indicated by the pattern information are a specific pattern or not by referring to all the winning bingo numbers stored at the winning-bingo-number storing area and the pattern information stored at a pattern-information storing area of the RAM 603 (S25). In addition, there are a total of eight rows that are vertical, horizontal and diagonal rows on a bingo card consisting of 3 rows and 3 columns, as the specific patterns in the present embodiment.

In the present embodiment, any one of the following prizes, that is, a token payout prize that a predetermined number of tokens are paid out to the play field 500, an normal ball-supply prize that the ball B1 is supplied to the play field 500 and a special ball-supply prize that the ball B2 is supplied to the play field 500, is allocated to each of the specific patterns. In the above bingo decision, where the control device 601 decides that it is not a specific pattern, that is, BINGO is not established (No in S25), the bingo game is finished.

On the other hand, where the control device 601 decides that BINGO is established (Yes in S25) and its specific pattern is related to the special ball-supply prize (Yes in S26), the control device 601 supplies a predetermined number of tokens M to the play field 500 by the same method as a case that the token supply combination such as the minor-combination A is awarded in the above-described slot game (S27-1). Also, the control device 601 supplies the ball B2 to the play field 500 by the same method as a case that the ball supply combination is awarded in the above-described slot game (S27-2). Further, where the specific pattern in which BINGO has been established is related to the normal ball-supply prize (Yes in S28), the control device 601 supplies a predetermined number of tokens M to the play field 500 by the same method as a case that the token supply combination such as the minor-combination A is awarded in the above-described slot game (S29-1). Also, the control device 601 supplies the ball B1 to the play field 500 by the same method as a case that the ball supply combination is awarded in the above-described slot game (S29-2). Still further, where the specific pattern in which BINGO has been established is related to the token supply prize (No in S28), the control device 601 supplies a predetermined number of tokens M to the play field 500 by the same method as a case that the token supply combination such as the minor-combination A is awarded in the above-described slot game (S30). In addition, the number of tokens M supplied to the play field 500 on establishment of BINGO may be the number different in each of the prizes related to the establishment of BINGO or may be the same number.

After the control device 601 has executed the process after establishment of BINGO as described above, the control device 601, which is the pattern-information generating unit, functions as pattern-information generating means, executing a pattern-information generating program stored at the ROM 602 to generate new pattern information. Thereby, the pattern information stored in a pattern-information storage area of the RAM 603 changes to the thus generated new pattern information to reset the pattern information (S31).

Figure 20:
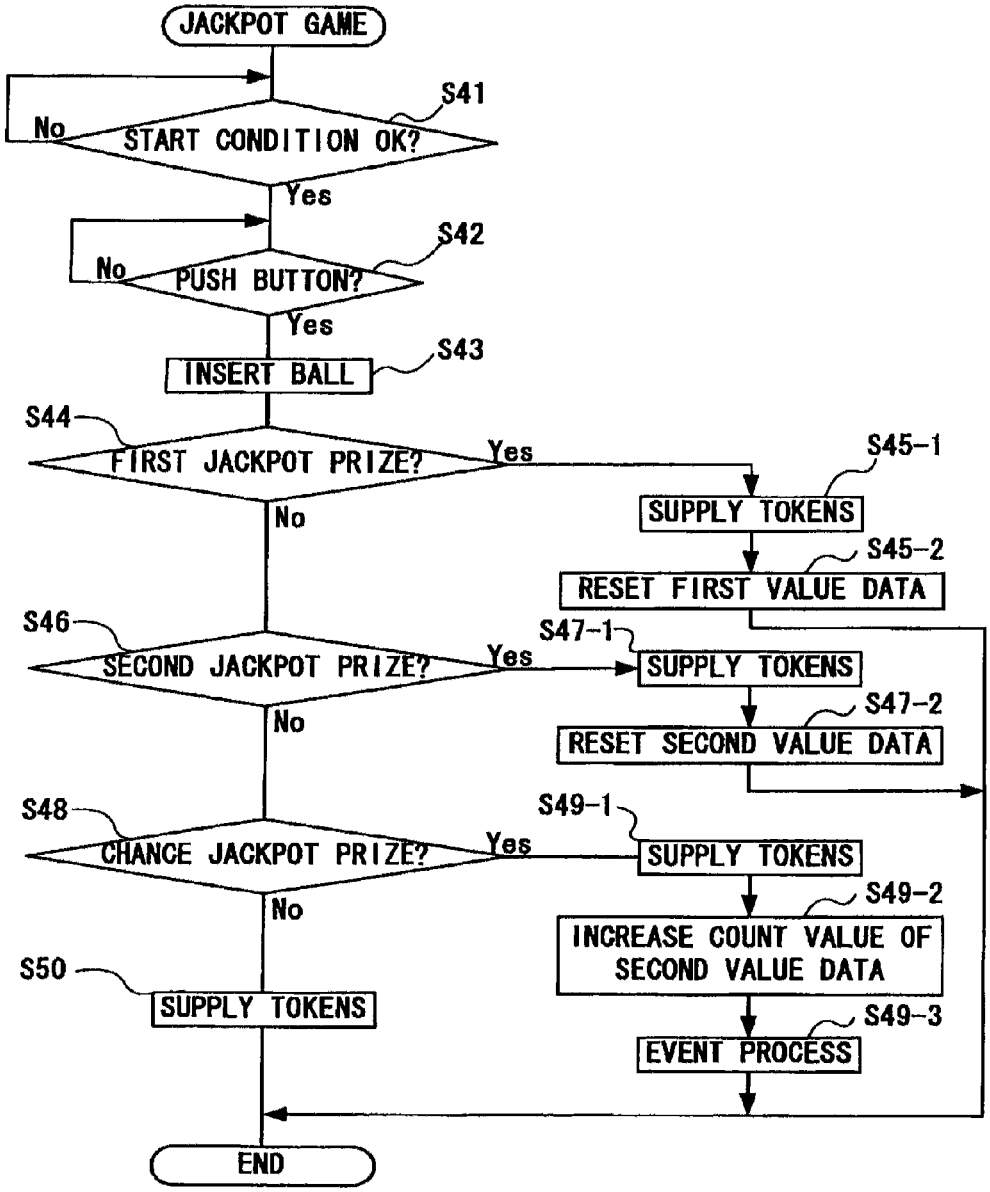
FIG. 20 is a flow chart showing a flow of a jackpot game carried out in the pusher game machine.

(Flow of jackpot drawing) Next, a description is given of the flow of the jackpot game progressed at the present pusher game machine 1. FIG. 20 is a flow chart showing the flow of the jackpot game in the present embodiment. In the jackpot game of the present embodiment, where the start condition of the jackpot game is satisfied (S41), that is, the ball B1 or B2 enters into the winning spot to which a right for starting the jackpot game in the center drawing device 2000 is allocated by the physical drawing in the satellite drawing device 1000 of the above-described bingo game, or the direct center combination is awarded in the above-described slot game, the control device 621 of the control unit 620 in the center drawing device 2000 execute a jackpot execution program stored in the ROM 622 to start the jackpot game. More specifically, the control device 621 controls for driving so that the device supporting base 2200 rotates and thereby the front of the center drawing device 2000 faces the satellite unit SA including the station unit ST that satisfies the start condition of the jackpot game. Further, the control device 621 makes the display device 2300 display a performance screen of the jackpot game, and controls the display device 2300 for displaying.

Thereafter, when a player who plays at the above station unit ST pushes the button 160 of the station unit ST (S42), its button operating signal is input into the control device 601 of the control unit 600 in the station unit ST. Thereby, the control device 601 outputs the ball inserting order to the control device 621 of the control unit 620 in the center drawing device 2000 via the control unit 610 of the satellite drawing device 1000. Thereby, the control device 621 outputs the ball inserting order to the large-ball-inserting-mechanism 2500. The large-ball-inserting-mechanism 2500 that has received the ball inserting order moves the ball stopper 2521 from the ball retaining position to the ball releasing position and inserts the large drawing ball 2400 retained at the ball retaining part 2520 into the transfer slope 2600 (S43). Thereby, the large drawing ball 2400 moves like a pendulum on the transfer slope 2600 around the lowest point thereof, and finally enters into any one of the retention spaces F of the rotational transfer device 2100. When the large drawing ball 2400 enters into any one of the retention spaces F, its signal is sent to the control device 621 of the control unit 620 in center drawing device 2000. Thereby, the control device 621 is able to recognize the retention space F into which the large drawing ball 2400 has entered.

At this time, where the retention space F into which the large drawing ball 2400 has entered is allocated the first jackpot prize JP1 (Yes in S44), the control device 621, which is a payout processing unit, functions as payout processing means and executes processing for reading out the first value data, which is payout amount data, from the RAM 623 which is a storage unit functioning as storage means, and for supplying the number of tokens M indicated by a count value of the first value data to the play field 500 of the station unit ST which has satisfied the start condition of the jackpot game (S45-1). At this time, the token supply order may be output from the control device 621 to the control device 601 of the control unit 600 in the station unit ST to supply tokens M to the play field 500 under the control of the control device 601 by the same method as the above-described normal token supply process. However, the number of tokens supplied when the first jackpot prize JP1 is awarded is such that the number of tokens (for example, 0.03 pieces) corresponding to part of the number of tokens inserted into all the station units ST is cumulatively added from a time when the first value data is reset to an initial value (for example, 500 pieces), therefore, it is a great number. For this reason, a token supply process using an original token supply mechanism may be used for this token supply process in separation from the above-described normal token supply process. This is also preferable as a performance made in a case where the first jackpot prize JP1 is awarded. Further, the control device 621 resets the first value data stored at the RAM 623 to the initial value (S45-2).

Still further, where the retention space F into which the large drawing ball 2400 has entered is allocated the second jackpot prize JP2 (Yes in S46), the control device 621, which is a payout processing unit, functions as payout processing means and executes processing for reading out the second value data, which is payout amount data, from the RAM 623 which is a storage unit functioning as storage means, and for supplying the number of tokens M indicated by a count value of the second value data to the play field 500 of the station unit ST which has satisfied the start condition of the jackpot game (S47-1). At this time, the token supply order may be output from the control device 621 to the control device 601 of the control unit 600 in the station unit ST to supply tokens M to the play field 500 under the control of the control device 601 by the same method as the above-described normal token supply process. However, the number of tokens supplied when the second jackpot prize JP2 is awarded is such that a predetermined number of tokens (for example, 100 pieces) are cumulatively added every time the chance pocket prize CP is awarded by the jackpot game from a time when the second value data is reset to an initial value (for example, 500 pieces), therefore, it is a great number. For this reason, a token supply process using an original token supply mechanism may be used for this token supply process in separation from the above-described normal token supply process. This is also preferable as a performance made in a case where the second jackpot prize JP2 is awarded. Further, the control device 621 resets the second value data stored at the RAM 623 to the initial value (S47-2).

In the present embodiment, even if a player who plays at any one of the station units ST wins the first jackpot prize JP1, the second value data related to the second jackpot prize JP2 will not be reset. Similarly, even if a player who plays at any one of the station units ST wins the second jackpot prize JP2, the first value data related to the first jackpot prize JP1 will not be reset. In other words, after either of the jackpot prizes is won by a certain player, the jackpot value of another jackpot prize is kept as it is. Therefore, where a certain player wins either of the jackpot prizes, remaining players are less desirous of winning this jackpot prize but have a strong desire to win another jackpot prize. As a result, the game attractiveness of other player is not reduced at all even if a certain player has won either of the jackpot prizes. On the contrary, such an effect that the game attractiveness is further enhanced is expected.

Also, in the present embodiment, where the retention space F into which the large drawing ball 2400 has entered is allocated the chance pocket prize CP (Yes in S48), the control device 621 outputs the token supply order to the control device 601 of the control unit 600 in the station unit ST which satisfies the start condition of the jackpot game. Accordingly, a predetermined number of tokens M (for example, 100 pieces) are supplied to the play field 500 of the station unit ST by the same method as a case that the token supply combination such as the minor-combination A is awarded in the above-described slot game (S49-1).

Also, where the retention space F into which the large drawing ball 2400 has entered is allocated the chance pocket prize CP (Yes in S48), the control device 621, which is a payout-amount increasing unit, functions as payout-amount increasing means and also executes a process for cumulatively increasing a count value jackpot value) of the second value data stored at the RAM 623 only by a predetermined amount (for example, 100 pieces) (S49-2).

Still further, where the retention space F into which the large drawing ball 2400 has entered is allocated the chance pocket prize CP (Yes in S48), the control device 621 outputs an event starting order to the control device 611 of the control unit 610 in the satellite drawing device 1000 of the satellite unit SA to which the station unit ST belongs. The control device 611 which has received the order decides that a predetermined event condition has been satisfied and executes an event process in which during a subsequent predetermined event period, a winning bingo number selected by the physical drawing of the bingo game carried out at any one of four station units ST belonging to the satellite unit SA is handled as a winning bingo number also in the other three station units ST (S49-3). More specifically, the control device 611 outputs information indicating the winning bingo number selected in the physical drawing by the satellite drawing device 1000 carried out during the predetermined event period to the control device 601 of the control unit 600 in all the station units ST belonging to the satellite unit SA.

In addition, where the retention space F into which the large drawing ball 2400 has entered is allocated the token supply prizes M100 or M500 (No in S48), the control device 621 outputs the token supply order for supplying the number of tokens corresponding to the type of the token supply prizes M100 and M500 to the control device 601 of the control unit 600 in the station unit ST which has satisfied the start condition of the jackpot game. Accordingly, a predetermined number of tokens M (100 pieces or 500 pieces) are supplied to the play field 500 of the station unit ST by the same method as a case that the token supply combination such as the minor-combination A is awarded in the above-described slot game (S50).

Next, a description is given of a time-limited-event. There is a case where the game progression until the above-mentioned jackpot game in each pusher game machine 1 flows in a state that the operation mode of each pusher game machine 1 is a normal mode (a first mode). In the present embodiment, when the time-limited-event is started, the operation mode of each pusher game machine 1 simultaneously changes to a event mode (a second mode) in which winning probabilities of the jackpot prizes JP1, JP2 (specified prizes) is higher than the case of the normal mode. Hereinafter, a description is given of it.

Figure 21:
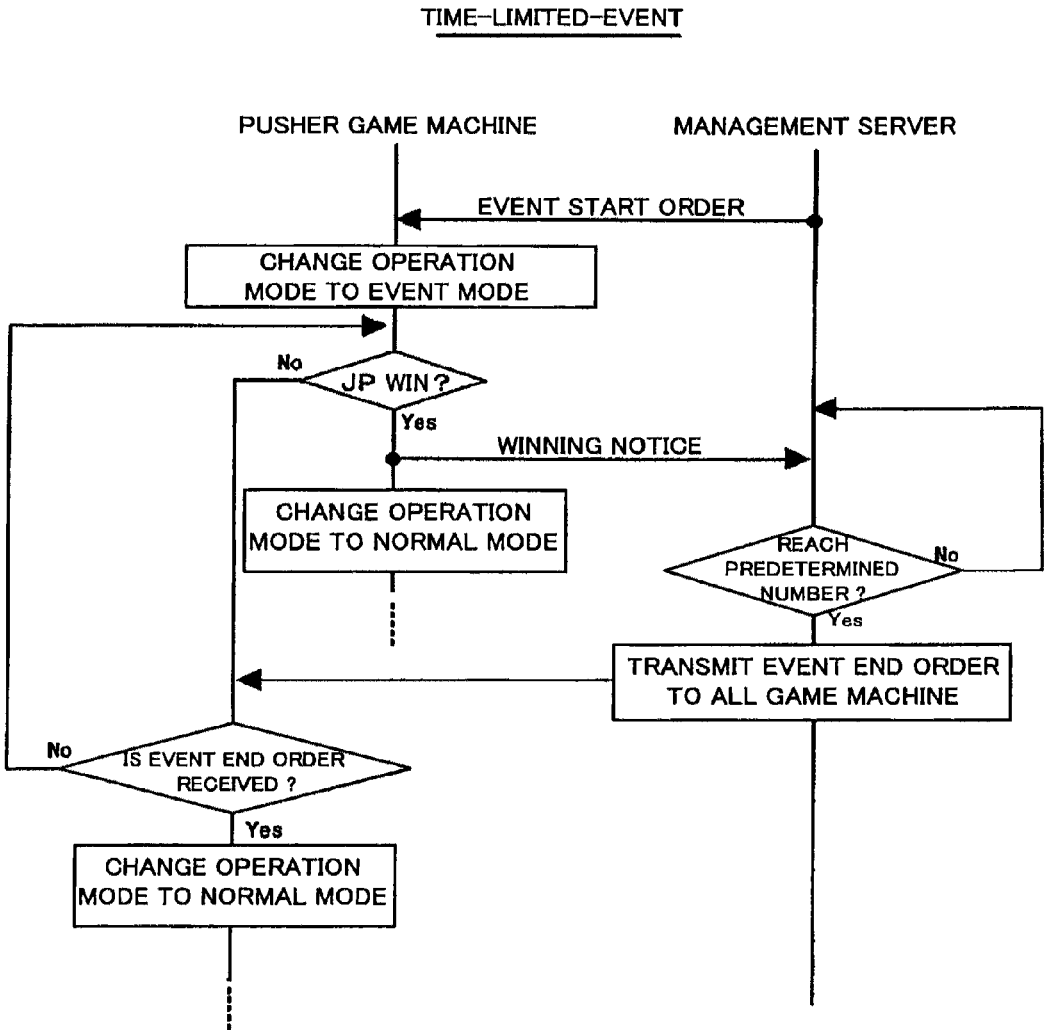
FIG. 21 is a sequential flow view showing a flow of the time-limited-event in the present game system.

FIG. 21 is an sequential flow view showing a flow of the time-limited-event in the present embodiment. In FIG. 21, for a description, only one pusher game machine 1 is shown. In the management server 4000, the control device 4001, which is a event start condition decision unit, functions as event start condition decision means and decides whether a event start condition that a predetermined event start timing comes is satisfied or not. In the present embodiment, the event start timing is set, for example, at 10:00 a.m. every day. But the event start condition is not limited such a condition that a predetermined day and time comes. For example, the event start condition may be set such that the event start condition is satisfied whenever the number of times won reaches 100 times in the whole present game system. When the control device 4001 decides that the event start condition is satisfied, the control device 4001 instruct an outside communication device 4003 to output a event start order to all of the pusher game machines 1 constituting the present game system. Thereby, the each pusher game machine 1 received this event start order decides that the event start condition is satisfied and simultaneously executes a process to change its operation mode to the event mode.

In addition, as a way to make the each pusher game machine 1 simultaneously to decide that the event start condition is satisfied, it is not limited that the event start order is output from the management server 4000 to the each pusher game machine 1 such as the present embodiment. For example, where the event start condition is a condition that the predetermined day and time comes, it can be listed that a time check unit functioning as time check means is installed into the each pusher game machine 1 and the each pusher game machine 1 individually decides whether the event start timing comes by utilizing the time check unit of the each pusher game machine 1.

When the operation mode of the each pusher game machine 1 is changed to the event mode, the winning probabilities of the jackpot prizes JP1, JP2 become higher than the case of the normal mode. In the present embodiment, as a way to raise the winning probabilities of the jackpot prizes JP1, JP2, it is adopted that the winning probability of the direct center combination in the each slot game is raised. Concretely, in the digital drawings in the slot game, a winning table for the event mode is used. The winning table for the event mode is set that the winning probability of the direct center combination is higher than the case of a winning table for the normal mode utilized in the normal mode. As a result, the control unit 610, which is a mode changing unit, of the satellite drawing device 1000 in the each pusher game machine 1 functions as a mode changing means. In addition, as a way to raise the winning probabilities of the jackpot prizes JP1, JP2, it is not limited to this case, for example, it may be a way that all the chance pocket prizes CP of the jackpot game are replaced by the jackpot prizes JP1, JP2.

In all of the pusher game machines 1, the operation mode of which has been changed to the event mode, players can play in a state that the winning probabilities of the jackpot prizes JP1, JP2 is high. Therefore, players are easier to award the jackpot prizes JP1, JP2 than the case of the normal mode. And, where the jackpot prize JP1 or JP2 is awarded in a certain pusher game machine 1, the control unit 620, which is a winning notice unit, of the center drawing device 2000 in its pusher game machine 1 functions as winning notice means and transmits a winning notice to the management server 4000. After that, the control unit 610 of the satellite drawing device 1000 in its pusher game machine 1 changes the winning table used in the digital drawings of the slot game from the winning table for event mode to the winning table for normal mode. Thereby, the operation mode of this pusher game machine 1 becomes the normal mode.

As a way to raise the winning probabilities of the jackpot prizes JP1, JP2, it is not limited that winning probabilities in the digital drawings of the slot game is changed, it may be other way. For example, an indication corresponding to the each winning spot of the outer bingo stage 1100 or the inner bingo stage 1200 shown in FIG. 8 may be formed changeable, and the number of the winning spots 1101, 1201 allotted a right for staring the drawing at the center drawing device 2000 may be increased. Also, for example, an indication corresponding to the each retention space F in the center drawing device 2000 shown in FIG. 15 may be formed changeable, and the number of the retention spaces F allotted the jackpot prizes JP1, JP2 may be increased.

In addition, in the present embodiment, the number of times awarding the jackpot prize JP1 or JP2 in the event mode is only once, but it may be twice or more. Also, the event mode may be kept up until a event end order to be described later is received from the management server 4000. Furthermore, where a player identification information receiving unit functioning as player identification information receiving means, which reads a player identification information from a portable storage medium, such as a certification card or the like, stored the player identification information is installed into the pusher game machines and it is composed such that a process can be individually executed every player, it is possible that the number of times awarding the jackpot prize JP1 or JP2 in the event mode is limited to each player once.

In the management server 4000, the control device 4001, which is a decision unit, functions as decision means for deciding whether the number of the winning notices transmitted from the each pusher game machine 1 reaches a predetermined number or not, after outputting the event start order. In addition, as described above, since the number of times awarding the jackpot prize JP1 or JP2 in the event mode at the each pusher game machine is once in the present embodiment, the number of the winning notices of this case is equal to the number of the pusher game machines sending the winning notice. If the number of times awarding the jackpot prize JP1 or JP2 in the event mode is twice or more and the event end condition is decided based on whether the number of the pusher game machines sending the winning notice reaches the predetermined number, for example, an identification information of the each pusher game machine transmitting the winning notice is added to its winning notice, the number of the identification information may be counted. In addition, the above-mentioned predetermined number in the present embodiment is set to the number less than the number of the pusher game machines constituting the present game system.

When the control device 4001 of the management server 4000 decides that the number of the winning notices reaches the predetermined number, the control device 4001 outputs the event end order to all the pusher game machines 1. The operation mode of the each pusher game machine 1 received this event end order is changed to normal mode if the event mode is kept up. However, if the operation mode of the pusher game machine 1 received the event end order is already the normal mode, the operation mode is not changed.

As described above, in the present embodiment, since the jackpot prize JP1 or JP2, which is usually difficult to be awarded, is easily awarded during the time-limited-event and the winning of a predetermined number of times is guaranteed, a big effect of attracting players is expected. As a result, by widely advertising widely to carry out such a time-limited-event, a lot of players can be urged to play at the each pusher game machine 1. And, the time-limited-event is carried out in the state that a lot of players are crowded, thereby the number of players who experiences to award the jackpot prizes JP1, JP2 and the number of bystanders who see the awarding largely increase. Therefore, even in the subsequent normal mode, the effect of attracting players by utilizing the jackpot game is improved. Moreover, in the present embodiment, the number of the winning notices, that is, the number of the pusher game machines occurred the winning, reaches the predetermined number set to the number less than the total number of the pusher game machines constituting the present game system, thereby the time-limited-event is finished and the operation of all the pusher game machines become the normal mode. Therefore, by setting the predetermined number appropriately, the number of players who experiences to obtain a great number of the tokens by the winning of the jackpot prizes JP1, JP2 and the number of bystanders who see the player winning the jackpot prizes JP1, JP2 can be increased within an extent that the management of the payout ratio in each pusher game machine is possible enough, so that the effect of attracting players by utilizing the jackpot game can be improved. Also, in the present embodiment, a description was given of a case where prizes, the winning probability of which in the event mode is higher than that in the normal mode, are the jackpot prizes JP1, JP2, they are not limited to the jackpot prize if the prizes is prizes, the winning probabilities of which are very low, such that players desire to win.

By the way, the payout ratio (a ratio of the number of paid out tokens to the number of inserted tokens) is higher than the conventional case where such an event is not carried out as much as the winning probabilities of the jackpot prizes JP1, JP2 raises by carrying out the time-limited-event. As a result, there is an apprehension that a profit of each game arcade where the pusher game machine is installed worsens. Allowing for carrying out the time-limited-event previously, for example, a setting of winning probabilities of each prize in the normal mode is determined such that a payout ratio during the normal mode is set low, thereby it is possible that a total payout ratio including payout ratios in the normal mode and the event mode is set to the target payout ratio similar to conventional one. By this way, it is theoretically possible to converge a payout ratio to a target payout ratio in the long view. However, the number of tokens paid out all at once by awarding the jackpot prize JP1 or JP2 is a lot. Therefore, where a situation in which, for example, the jackpot prizes JP1, JP2 are frequently awarded by chance is occurred, a very long time is necessary to recover the payout ratio of its pusher game machine 1 to the target payout ratio, thereby there is a case where it is actually difficult to recover the payout ratio of its pusher game machine 1 to the target payout ratio. Contrary, where a situation such that the jackpot prizes JP1, JP2 are not awarded at all is occurred, a very long time is necessary to recover the payout ratio of its pusher game machine 1 to the target payout ratio, thereby there is a case where it is actually difficult to recover the payout ratio of its pusher game machine 1 to the target payout ratio, too.

Therefore, the each pusher game machine 1 of the present embodiment includes a payout ratio adjusting unit functioning as payout ratio adjusting means. Concretely, the number of tokens used by players in the slot game, bingo game, jackpot game, or the like during a predetermined period and the number of tokens actually paid out to players during this predetermined period are totaled. And, for example, the control device 610 of the satellite drawing device 1000 adjusts the winning probabilities of each prize in the winning table used at the slot game such that a ratio of these numbers closes to a preset payout ratio. In addition, if only it is possible to adjust the payout ratio of the pusher game machine 1, the payout ratio may be adjusted by other control device 600, 620, not the control device 610 of the satellite drawing device 1000.

Variation Example

Next, a description is given of a variation example of the time-limited-event in the present embodiment. In the present variation example, when the time-limited-event is started, the operation of all the pusher game machines 1 is simultaneously changed to the event mode. A content of the operation of the event mode in the present variation example is different form the case of the above-mentioned embodiment. That is, in the event mode of the present variation example, the winning probabilities of the jackpot prizes JP1, JP2 are the same probabilities as the normal mode, but when the jackpot prize JP1 or JP2 is awarded, a jackpot payout process (a second jackpot payout process) for paying out more tokens than the number of tokens paid out by a jackpot payout process in the normal mode (a first jackpot payout process) to the awarded player is executed. In addition, the winning probabilities of jackpot prizes JP1, JP2 in the event mode are may be changed to probabilities different from those in the normal mode. Hereinafter, a description is only given of a part different from the above-mentioned embodiment.

A concrete description is given of the present variation example. In the normal mode, if the first jackpot prize JP1 is awarded, tokens corresponding to a count value of the first value data are paid out, and if the second jackpot prize JP2 is awarded, tokens corresponding to a count value of the second value data are paid out, the same description as the above-mentioned embodiment. Upper limits of these count values are determined and both of them are, for example, 30,000, here. In the above-mentioned embodiment, the each jackpot prize JP1, JP2 is set such that the winning is occurred before the count values reach the each upper limit and thereby the count values is reset to the initial value. Therefore, a probability that tokens of 30,000 being the upper limit or the number almost this are paid out is very low. However, if players experience that such a lot of tokens are paid out such that players cannot usually experience and bystanders see that such a lot of tokens are paid out, thereby it can be expect to get an very high effect of attracting players.

Therefore, in the present variation example, a control is executed such that tokens of 30,000 being the upper limit are paid out whenever the jackpot prize JP1 or JP2 is awarded in the event mode without a relation the count values of the first value data and the second value data. Concretely, the control device 620 being a mode changing unit of the center drawing device 2000 in each pusher game machine 1 functions as mode changing means and executes a process for supplying tokens M of 30,000 being the upper limit to the play field 500 of the station ST in which a start condition of the jackpot game are satisfied if the retention space F into which the large drawing ball 2400 has entered is allocated the first jackpot prize JP1 or the second jackpot prize JP2. In addition, in the present variation example the number of tokens paid out when the jackpot prize JP1 or JP2 is awarded in the event mode is set to a maximum number of tokens paid out when the jackpot prize JP1 or JP2 is awarded in the normal mode. But, it may be set to a number less than the maximum number of tokens as long as the set number of tokens is a lot of tokens such that it is usually almost nothing to be paid out when the jackpot prize JP1 or JP2 is awarded in the normal mode.

In all the pusher game machines 1 changed to the event mode, the number of tokens paid out to a player who awarded to the jackpot prize JP1 or JP2 is always the maximum number. Therefore, the number of tokens that the player obtains when the jackpot prize JP1 or JP2 is awarded is a lot of tokens such that it is usually almost nothing to obtain when the jackpot prize JP1 or JP2 is awarded in the normal mode. The later processing is similar to the above-mentioned embodiment.

In the present variation example, if there is a player who was satisfying the start condition of the jackpot game yet at a time when the pusher game machine 1, the operation of which is the event mode, receives the event end order, the jackpot game concerning the player is carried out in the event mode. That is, when this player awards the jackpot prize JP1 or JP2 in the jackpot game, the maximum number of tokens is paid out to the player even if after the event end order is received. Thereby, it can be prevent that a player who satisfies the start condition of the jackpot game during the event mode cannot take a benefit by the event. In addition, this process of the present variation example may be executed in the above-mentioned embodiment, too.

As described above, in the present variation example, if a player awards the jackpot prize JP 1 or JP2 during the time-limited-event, the player obtains a lot of tokens such as players cannot usually obtain all at once. Therefore, a big effect of attracting players is expected. As a result, by widely advertising widely to carry out such a time-limited-event, a lot of players can be urged to play at the each pusher game machine 1. And, the time-limited-event is carried out in the state that a lot of players are crowded, thereby the number of players who experiences to award the jackpot prizes JP1, JP2 and the number of bystanders who see the awarding largely increase. Therefore, even in the subsequent normal mode, the effect of attracting players by utilizing the jackpot game is improved. Moreover, in the present variation example, the number of the winning notices, that is the number of the pusher game machines occurred the winning, reaches the predetermined number set to the number less than the total number of the pusher game machines constituting the present game system, thereby the time-limited-event is finished and the operation of all the pusher game machines become the normal mode. Therefore, by setting the predetermined number appropriately, the number of players who experiences to obtain a great number of the tokens by the winning of the jackpot prizes JP1, JP2 and the number of bystanders who see the player winning the jackpot prizes JP1, JP2 can be increased within an extent that the management of the payout ratio in each pusher game machine is possible enough, so that the effect of attracting players by utilizing the jackpot game can be improved. Also, it is possible to make a player have consciousness that the time-limited-event is finished without a benefit by the event if the player awards the jackpot prize in the early time after starting the event, such as first come, first served. Therefore, player's willingness of a challenge is excited, thereby it is expected that players play the game mutually competing.

In addition, in the above-mentioned embodiment and variation example, a description was given of a case where the number of the winning notices, that is, the number of the pusher game machines occurred the winning, is totaled in the entire present game system and the time-limited-event is finished if this number reaches the predetermined number. However, viewed in a management of system or the like, it may be changed to a case where all the pusher game machines 1 are divided into a plurality of groups, the number of the winning notices or the number of the pusher game machines occurred the winning is totaled at every group, it is decided with each group whether the totaled number of each group reaches the predetermined number or not, and the time-limited-event is finished at the pusher game machines 1 belonging to the group that the number reaches the predetermined number. As a way of dividing into groups, for example, it is listed a way such that the pusher game machines 1 installed in gaming arcades where a unit price of the token (an amount of money that is necessary to borrow one piece of token) is equal each other belong to the same group. In this case, it is possible to cancel a feeling of unfairness among gaming arcades that a unit price of the token is different from each other. Moreover, for example, it is listed a way that the pusher game machines 1 are divided into groups at every location where each game apparatus is placed. In this case, it is possible to avoid that a benefit by the time-limited-event concentrates on a part of locations Also, in the above-mentioned embodiment and variation example, a description was given of a case where a timing of simultaneously changing operations of each pusher game machine 1 to the event mode is a timing when a predetermined date and time or a predetermined time comes, but it is limited to this case. For example, an event such as the above-mentioned time-limited-event may be occurred whenever the number of winning of the jackpot prizes JP1, JP2 in the entire present game system reaches 100 times. In this case, the management server 4000 totals the number of winning of jackpot prizes JP1, JP2 in the each pusher game machine 1 and output the event start order to all of the pusher game machines whenever the totaled number of winning of the jackpot prizes JP1, JP2 reaches 100 times.

In the present embodiment (including the above-mentioned variation example, similar as follows), a description was given of a case in which the center drawing device 2000, which is a drawing machine for jackpot game, is installed in the pusher game machine 1 that is an arcade game machine including a plurality of the station units ST at which mutually independent pusher games progress, and when the start condition of the jackpot game is satisfied at any one of the station units ST, the jackpot game is started at the center drawing device 2000. However, the present invention is not limited to the above-described case. The present invention is not limited to a plural-player play type game machine as described in the present embodiment in which a plurality of players play at the same time but applicable to a single-player play type game machine. The present invention is also applicable, for example, to a game system in which a plurality of game machines are connected to a drawing machine for jackpot game via a communication network and when the start condition of the jackpot game is satisfied in any of the game machines, the drawing machine for jackpot game starts the jackpot game.

Further, in the present embodiment, a description was given of a case where as a part of a drawing unit functioning as drawing means for carrying out the jackpot game, a drawing mechanism which carried out the physical drawing using the drawing moving object called the large drawing ball 2400 was exemplified. However, the present invention is not limited to the above case and may include a case where a digital drawing is carried out to decide whether any jackpot prize is awarded or not based on a drawing program using random numbers.

Still further, in the above embodiment, means realized by software such as computer programs may be realized by using hardware such as circuits and chips. Also, means realized by hardware such as circuits and chips may be realized by software such as computer programs.

The invention claimed is:

1. A game system, comprising:

a plurality of game apparatuses; and a management apparatus connected with the game apparatuses via a communication network;

wherein each game apparatus comprising:

a drawing unit for carrying out a drawing to decide whether a specified prize is won or not in accordance with a predetermined winning probability when a predetermined drawing start condition is satisfied;

a game progression control unit for controlling progression of a game utilizing the drawing unit;

a mode changing unit for changing an operation mode of the drawing unit between a first mode and a second mode, wherein a winning probability of the specified prize in the first mode is lower than that in the second mode; and a winning notice unit for sending a winning notice to the management apparatus via the communication network when the drawing unit decides a winning of the specified prize in the second mode, wherein the mode changing unit of each game apparatus changes the operation mode of the drawing unit to the second mode at the same timing in each game apparatus, and changes the operation mode of the drawing unit to the first mode when the mode changing unit receives a second mode end information from the management apparatus via the communication network in the second mode, and wherein the management apparatus comprising:

a decision unit for deciding whether or not the number of the winning notices received from each game apparatus via the communication network or the number of the game apparatuses sending the winning notice via the communication network reaches a predetermined number; and an end information transmission unit for transmitting the second mode end information via the communication network to all of the game apparatuses in which the drawing unit operates in the second mode when the decision unit decides that the number of winning notices or that of the game apparatuses, reaches the predetermined number.

2. The game system according to claim 1, wherein each game apparatus comprises a bet object receiving unit for receiving a bet-object and a payout processing unit for executing a payout process to pay out a predetermined amount of payout-objects to a player based on a result of a game, the progression of which is controlled by the game progression control unit, on the condition that the bet object receiving unit receives the bet-object, wherein the amount of payout-objects that can be obtained by the player in case where the winning of the specified prize is decided is set more than that in case where the winning of the specified prize is not decided, and wherein each game apparatus further comprises a payout ratio adjusting unit for carrying out a control such that a payout ratio, which is a ratio of the amount of payout-objects paid out by the payout processing unit in a predetermined period to the amount of bet-objects received by the bet object receiving unit in the above-mentioned predetermined period, is close to a predetermined preset payout ratio.

3. A game system, comprising:

a plurality of game apparatuses; and a management apparatus connected with the game apparatuses via a communication network, wherein each game apparatus comprising:

a drawing unit for carrying out a jackpot game to decide a winner who is awarded a jackpot prize when a predetermined drawing start condition is satisfied;

a game progression control unit for controlling progression of a game utilizing the drawing unit;

a payout amount storage unit for storing payout amount data including information of an amount of payout-objects to be paid out to the player when the drawing unit decides a winner of the jackpot prize;

a jackpot payout processing unit for executing, when the drawing unit decides a winner of the jackpot prizes, a first jackpot payout process in which the amount of payout-objects is at least part of an amount indicated by the payout amount data read from the payout amount storage unit, is paid out to the awarded player or a second jackpot payout process in which the amount of payout-objects which is more than the amount of payout-objects paid out by the first jackpot payout process, is paid out to the awarded player;

a payout-amount increasing unit for increasing cumulatively an amount indicated by the payout amount data stored in the payout amount storage unit whenever a predetermined payout amount increasing condition is satisfied;

a mode changing unit for changing an operation mode of the jackpot payout processing unit between a first mode for executing the first jackpot payout process and a second mode for executing the second jackpot payout process; and a winning notice unit for sending a winning notice to the management apparatus via the communication network when the drawing unit decides a winner of the jackpot prize in the second mode, wherein the mode changing unit of each game apparatus changes the operation mode of the jackpot payout processing unit to the second mode at the same timing in each game apparatus and changes the operation mode of the jackpot payout processing unit to the first mode when the mode changing unit receives a second mode end information from the management apparatus via the communication network in the second mode, and wherein the management apparatus comprising:

a decision unit for deciding whether or not the number of the winning notices received from each game apparatus via the communication network or the number of the game apparatuses sending the winning notice received via the communication network, reaches a predetermined number; and an end information transmission unit for transmitting the second mode end information via the communication network to all of the game apparatuses in which the jackpot payout processing unit operates in the second mode when the decision unit decides that the number of the winning notice or the number of apparatuses reaches the predetermined number.

4. A game system, comprising:

a plurality of game apparatuses; and a management apparatus connected with the game apparatuses via a communication network, wherein each game apparatus comprising:

a drawing unit for carrying out a jackpot game to decide a winner who is awarded a jackpot prize when a predetermined drawing start condition is satisfied;

a game progression control unit for controlling progression of a game utilizing the drawing unit;

a payout amount storage unit for storing payout amount data including information of an amount of payout-objects to be paid out to a player when the drawing unit decides a winner of the jackpot prize;

a jackpot payout processing unit for executing, when the drawing unit decides a winner of the jackpot prizes, a first jackpot payout process in which if an amount indicated by the payout amount data read from the payout amount storage unit is a predetermined upper limit or less, the amount of payout-objects which is the amount indicated by the payout amount data, is paid out to the awarded player and if the amount indicated by the payout amount data is more than the predetermined upper limit, the amount of payout-objects which is equal to the upper limit, is paid out to the awarded player or a second jackpot payout process in which the amount of payout-objects which is equal to the upper limit, is paid out to the awarded player;

a payout-amount increasing unit for increasing cumulatively an amount indicated by the payout amount data stored in the payout amount storage unit whenever a predetermined payout amount increasing condition is satisfied;

a mode changing unit for changing an operation mode of the jackpot payout processing unit between a first mode for executing the first jackpot payout process and a second mode for executing the second jackpot payout process; and a winning notice unit for sending a winning notice to the management apparatus via the communication network when the drawing unit decides a winner of the jackpot prize in the second mode, wherein the mode changing unit of each game apparatus changes the operation mode of the jackpot payout processing unit to the second mode at the same timing in each game apparatus and changes the operation mode of the jackpot payout processing unit to the first mode when the mode changing unit receives a second mode end information from the management apparatus via the communication network in the second mode, and wherein the management apparatus comprising:

a decision unit for deciding whether or not the number of the winning notices received from each game apparatus via the communication network or the number of the game apparatuses sending the winning notice received via the communication network, reaches a predetermined number; and an end information transmission unit for transmitting the second mode end information via the communication network to all of the game apparatuses in which the jackpot payout processing unit operates in the second mode when the decision unit decides that the number of the winning notices or the number of the game apparatuses, reaches the predetermined number.

5. The game system according to claim 3, wherein each game apparatus comprises a bet object receiving unit for receiving a bet-object, a payout processing unit for executing a payout process to pay out a predetermined amount of payout-objects to a player based on a result of a game, the progression of which is controlled by the game progression control unit, on the condition that the bet object receiving unit receives the bet-object, and a payout ratio adjusting unit for carrying out a control such that a payout ratio, which is a ratio of an amount of payout-objects paid out by the payout processing unit in a predetermined period to an amount of bet-objects received by the bet object receiving unit in the above-mentioned predetermined period, is close to a predetermined preset payout ratio.

6. The game system according to claim 4, wherein each game apparatus comprises a bet object receiving unit for receiving a bet-object, a payout processing unit for executing a payout process to pay out a predetermined amount of payout-objects to a player based on a result of a game, the progression of which is controlled by the game progression control unit, on the condition that the bet object receiving unit receives the bet-object, and a payout ratio adjusting unit for carrying out a control such that a payout ratio, which is a ratio of an amount of payout-objects paid out by the payout processing unit in a predetermined period to an amount of bet-objects received by the bet object receiving unit in the above-mentioned predetermined period, is close to a predetermined preset payout ratio.

7. The game system according to claim 1, wherein the mode changing unit of each game apparatus changes the operation mode of the drawing unit to the first mode when the drawing unit decides the winning of the specified prize in the second mode.

8. The game system according to claim 3, wherein the mode changing unit of each game apparatus changes the operation mode of the jackpot payout processing unit to the first mode when the drawing unit decides the winner of the jackpot prize in the second mode.

9. The game system according to claim 4, wherein the mode changing unit of each game apparatus changes the operation mode of the jackpot payout processing unit to the first mode when the drawing unit decides the winner of the jackpot prize in the second mode.

10. The game system according to claim 1, wherein the number of the above-mentioned game apparatuses is four or more, the decision unit of the management apparatus totals the number of the winning notices received from each game apparatus via the communication network or the number of the game apparatuses sending the winning notice via the communication network, in each of two or more groups, which are respectively composed of two or more game apparatuses, and decides whether or not the totaled number in each group reaches a predetermined number that is determined for each group, and when the decision unit decides that the number of the winning notices or the number of the game apparatuses reaches the predetermined number, the end information transmission unit of the management apparatus transmits the second mode end information via the communication network to all of the game apparatuses that belong to the group related to the decision of the decision unit.

11. The game system according to claim 3, wherein the number of the above-mentioned game apparatuses is four or more, the decision unit of the management apparatus totals the number of the winning notices received from each game apparatus via the communication network or the number of the game apparatuses sending the winning notice via the communication network, in each of two or more groups, which are respectively composed of two or more game apparatuses, and decides whether or not the totaled number in each group reaches a predetermined number that is determined for each group, and when the decision unit decides that the number of the winning notice or the number of game apparatuses reaches the predetermined number, the end information transmission unit of the management apparatus transmits the second mode end information via the communication network to all of the game apparatuses that belong to the group related to the decision of the decision unit.

12. The game system according to claim 4, wherein the number of the above-mentioned game apparatuses is four or more, the decision unit of the management apparatus totals the number of the winning notices received from each game apparatus via the communication network or the number of the game apparatus sending the winning notice via the communication network, in each of two or more groups, which are respectively composed of two or more game apparatuses, and decides whether or not the totaled number in each group reaches a predetermined number that is determined for each group, and when the decision unit decides that the number of the winning notice or the number of the game apparatuses reaches the predetermined number, the end information transmission unit of the management apparatus transmits the second mode end information via the communication network to all of the game apparatuses that belong to the group related to the decision of the decision unit.

13. The game system according to claim 1, wherein the mode changing unit of each game apparatus changes the mode to the second mode at the same timing as a predetermined date and time or a predetermined time.

14. The game system according to claim 3, wherein the mode changing unit of each game apparatus changes the operation mode to the second mode at the same timing as a predetermined date and time or a predetermined time.

15. The game system according to claim 4, wherein the mode changing unit of each game apparatus changes the operation mode to the second mode at the same timing as a predetermined date and time or a predetermined time.

16. The game system according to claim 1, wherein if the drawing relating to the predetermined drawing start condition satisfied before receipt of the second mode end information is not finished yet, the mode changing unit of each game apparatus changes the operation mode to the first mode after the end of this drawing, when the second mode end information is received in the second mode.

17. The game system according to claim 3, wherein if the drawing relating to the predetermined drawing start condition satisfied before receipt of the second mode end information is not finished yet, the mode changing unit of each game apparatus changes the operation mode to the first mode after the end of this drawing, when the second mode end information is received in the second mode.

18. The game system according to claim 4, wherein if the drawing relating to the predetermined drawing start condition satisfied before receipt of the second mode end information is not finished yet, the mode changing unit of each game apparatus changes the operation mode to the first mode after the end of this drawing, when the second mode end information is received in the second mode.

19. A game apparatus that is connected with a management apparatus via a communication network comprising:

a drawing unit for carrying out a drawing to decide whether or not a specified prize is won in accordance with a predetermined winning probability when a predetermined drawing start condition is satisfied;

a game progression control unit for controlling progression of a game utilizing the drawing unit;

a mode changing unit for changing an operation mode of the drawing unit between a first mode and a second mode wherein a winning probability of the specified prize in the first mode is lower than that in the second mode; and a winning notice unit for sending a winning notice to the management apparatus via the communication network when the drawing unit decides a winning of the specified prize in the second mode, wherein the mode changing unit changes the operation mode of the drawing unit to the second mode at a predetermined timing and changes the operation mode of the drawing unit to the first mode when the mode changing unit receives a second mode end information from the management apparatus via the communication network in the second mode.

20. A game apparatus that is connected with a management apparatus via a communication network comprising:

a drawing unit for carrying out a jackpot game to decide a winner who is awarded a jackpot prize when a predetermined drawing start condition is satisfied;

a game progression control unit for controlling progression of a game utilizing the drawing unit;

a payout amount storage unit for storing payout amount data including information of an amount of payout-objects to be paid out to a player when the drawing unit decides a winner of the jackpot prize;

a jackpot payout processing unit for executing, when the drawing unit decides a winner of the jackpot prizes, a first jackpot payout process in which the amount of payout-objects which is at least part of an amount indicated by the payout amount data read from the payout amount storage unit, is paid out to the awarded player or a second jackpot payout process in which the amount of payout-objects which is the amount of payout-objects paid out by the first jackpot payout process or more, is paid out to the awarded player;

a payout-amount increasing unit for increasing cumulatively an amount indicated by the payout amount data stored in the payout amount storage unit whenever a predetermined payout amount increasing condition is satisfied;

a mode changing unit for changing an operation mode of the jackpot payout processing unit between a first mode for executing the first jackpot payout process and a second mode for executing the second jackpot payout process; and a winning notice unit for sending a winning notice to the management apparatus via the communication network when the drawing unit decides a winner of the jackpot prize while the second mode is operated, wherein the mode changing unit changes the operation mode of the jackpot payout processing unit to the second mode at a predetermined timing and changes the operation mode of the jackpot payout processing unit to the first mode when the mode changing unit receives a second mode end information from the management apparatus via the communication network in the second mode.

21. A management apparatus that is connected with a plurality of the game apparatuses according to claim 19 via a communication network comprising:

a decision unit for deciding whether or not the number of the winning notices received from each game apparatus via the communication network or the number of the game apparatuses sending the winning notice via the communication network, reaches a predetermined number; and an end information transmission unit for transmitting a second mode end information via the communication network to each game apparatus when the decision unit decides that the number of the wining notices or the number of the game apparatuses, reaches the predetermined number.

22. A management apparatus that is connected with a plurality of the game apparatus according to claim 20 via a communication network comprising:

a decision unit for deciding whether or not the number of the winning notices received from each game apparatus via the communication network or the number of the game apparatuses sending the winning notice via the communication network, reaches a predetermined number; and an end information transmission unit for transmitting a second mode end information via the communication network to each game apparatus when the decision unit decides that the number of the winning notices or the number of the game apparatuses, reaches the predetermined number.

23. The management apparatus according to claim 21, wherein the decision unit totals the number of the winning notices received from each game apparatus via the communication network or the number of the game apparatuses sending the winning notice via the communication network, in each of two or more groups, which are respectively composed of two or more game apparatuses, and decides whether or not the totaled number in each group reaches a predetermined number that is determined for each group, and when the decision unit decides that the number of the winning notices or the number of the game apparatuses reaches the predetermined number, the end information transmission unit transmits the second mode end information via the communication network to all of the game apparatuses that belong to the group related to the decision of the decision unit.

24. The management apparatus according to claim 22, wherein the decision unit totals the number of the winning notices received from each of the game apparatus via the communication network or the number of the game apparatus sending the winning notice via the communication network, in each of two or more groups, which are respectively composed of two or more game apparatuses, and decides whether or not the totaled number in each group reaches a predetermined number that is determined for each group, and when the decision unit decides that the number of the winning notices or the number of the game apparatuses reaches the predetermined number, the end information transmission unit transmits the second mode end information via the communication network to all of the game apparatuses that belong to the group related to the decision of the decision unit.

* * * * *